US005901691A

United States Patent [19]

Katoh

[11] Patent Number: 5,901,691

[45] Date of Patent: May 11, 1999

[54] DEVICE FOR DETERMINING DETERIORATION OF AIR-FUEL RATIO SENSOR

[75] Inventor: Kazunori Katoh, Nagoya, Japan

[73] Assignee: Toyota Jidosha Kabushiki Kaisha, Toyota, Japan

[21] Appl. No.: 08/902,102

[22] Filed: Jul. 29, 1997

[30] Foreign Application Priority Data

Aug. 9, 1996 [JP] Japan ..... 8-211785

[51] Int. Cl.[6] ..... F02M 25/00

[52] U.S. Cl. ..... 123/688; 73/23.32; 123/690

[58] Field of Search ..... 123/688, 690; 73/23.32, 118.1

[56] References Cited

U.S. PATENT DOCUMENTS

| | | | |
|---|---|---|---|
| 5,485,382 | 1/1996 | Seki et al. . | |
| 5,724,952 | 3/1998 | Miyashita et al. | 123/688 |
| 5,724,953 | 3/1998 | Jung | 123/688 |
| 5,758,632 | 6/1998 | Yamashita et al. | 123/688 |
| 5,769,063 | 6/1998 | Mizusawa | 123/688 |

FOREIGN PATENT DOCUMENTS

| | | |
|---|---|---|
| A-62-247148 | 10/1987 | Japan . |
| A-5-99043 | 4/1993 | Japan . |
| B2-5-38139 | 6/1993 | Japan . |

*Primary Examiner*—John T. Kwon
*Attorney, Agent, or Firm*—Oliff & Berridge, PLC

[57] ABSTRACT

A device for determining deterioration of an air-fuel ratio sensor according to the present invention includes: an air-fuel ratio sensor provided in an exhaust passage of an internal combustion engine, the air-fuel ratio sensor being capable of continuously detecting a broad range of air-fuel ratios including a stoichiometric air-fuel ratio; an air-fuel ratio feedback control circuit for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine; a variation cumulative value calculation circuit for cumulating, while the air-fuel ratio feedback control is being performed by the air-fuel ratio feedback control circuit, a variation ΔFT in a fuel injection correction amount, thereby calculating a cumulative variation value ΣΔFT for a predetermined period; and a deterioration determination circuit for determining that the air-fuel ratio sensor is deteriorated when the cumulative variation value ΣΔFT calculated by the variation cumulative value calculation circuit exceeds a predetermined value.

7 Claims, 20 Drawing Sheets

*FIG. 6*

| | n calls ago | ---- | 2 calls ago | 1 call ago | Current |
|---|---|---|---|---|---|
| Estimated inner-cylinder air amount | $MC_n$ | ---- | $MC_2$ | $MC_1$ | $MC_0$ |
| Target inner-cylinder fuel amount | $FCR_n$ | ---- | $FCR_2$ | $FCR_1$ | $FCR_0$ |

High-response sensor
Low-response sensor

Lean
Stoichiometric
A/F ratio VAFT
Rich
A/F ratio sensor
output
VAF
VAF'
t
ΔV
ΔV'

Variation in fuel
injection correction
(FIC) amount
FT
FT'
ΔFT
ΔFT'
to
t1

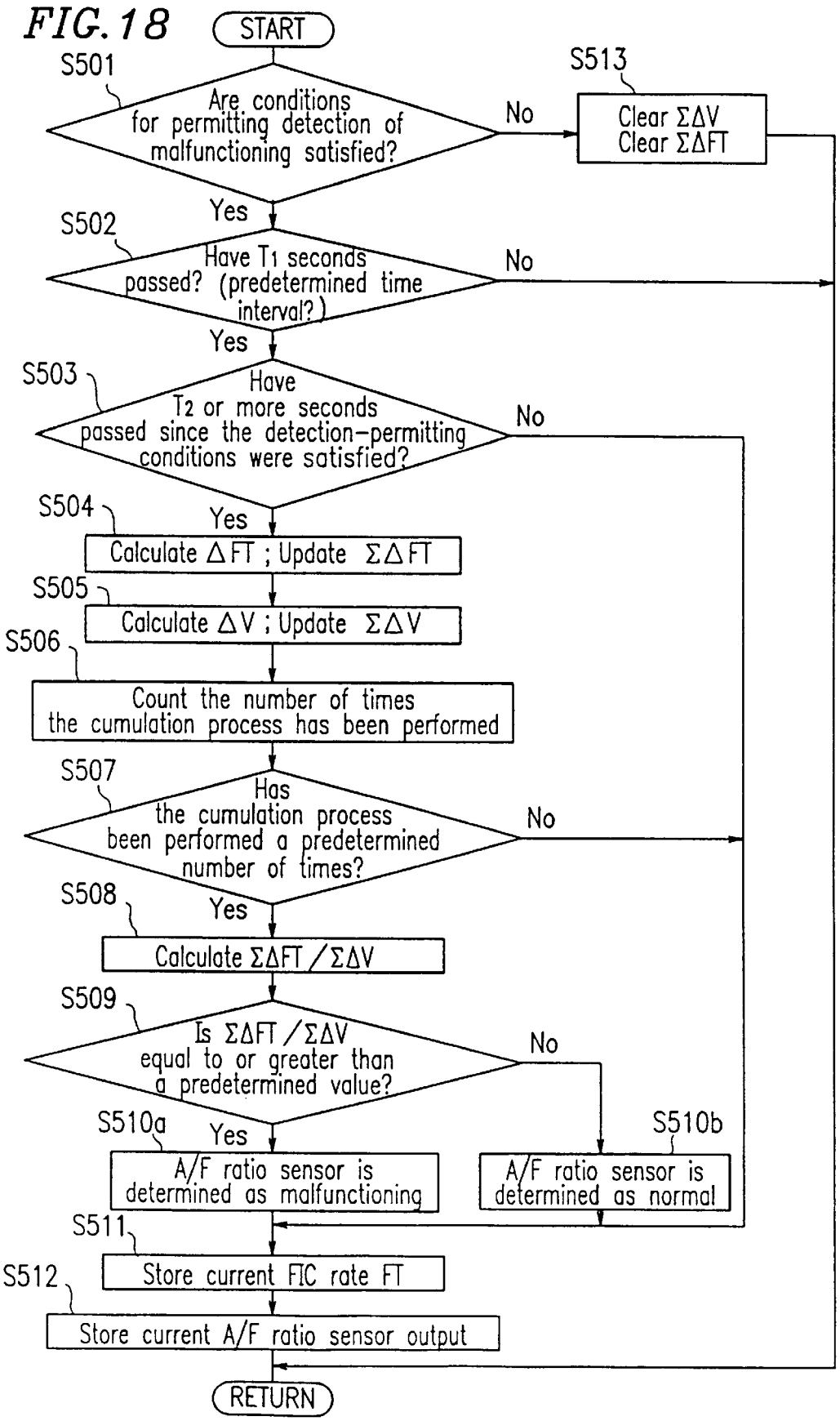
FIG. 18
START
S501
Are conditions for permitting detection of malfunctioning satisfied?
No
S513
Clear ΣΔV
Clear ΣΔFT
Yes
S502
Have T1 seconds passed? (predetermined time interval?)
No
Yes
S503
Have T2 or more seconds passed since the detection-permitting conditions were satisfied?
No
S504
Yes
Calculate ΔFT ; Update ΣΔFT
S505
Calculate ΔV ; Update ΣΔV
S506
Count the number of times the cumulation process has been performed
S507
Has the cumulation process been performed a predetermined number of times?
No
S508
Yes
Calculate ΣΔFT / ΣΔV
S509
Is ΣΔFT / ΣΔV equal to or greater than a predetermined value?
No
S510a
Yes
A/F ratio sensor is determined as malfunctioning
S510b
A/F ratio sensor is determined as normal
S511
Store current FIC rate FT
S512
Store current A/F ratio sensor output
RETURN

DEVICE FOR DETERMINING DETERIORATION OF AIR-FUEL RATIO SENSOR

BACKGROUND OF THE INVENTION

1. Field of the Invention

The present invention relates to a device for determining the deterioration of an air-fuel (A/F) ratio sensor employed in an air-fuel ratio control device of an internal combustion engine in order to control the air-fuel ratio (i.e., the ratio at which air and fuel are mixed together) at a desired value, by supplying fuel in accordance with the amount of air intake More specifically, the present invention relates to a device for determining the deterioration of an A/F ratio sensor located upstream of an exhaust gas purification catalyst for A/F feedback control, the A/F ratio sensor being capable of linearly detecting the air-fuel ratio.

2. Description of the Related Art

Conventionally, automobile engines employ a three-way catalyst as means for purifying their exhaust gas, where the three-way catalyst simultaneously promotes the oxidation of the unburnt components (hydrocarbons (HC), and/or carbon monoxide (CO)) and the reduction of nitrogen oxides ($NO_x$). In order to enhance the oxidation and/or reduction ability of the three-way catalyst, it is necessary to control the A/F ratio (which indicates the state of combustion within the engine) to be in the vicinity (or "window") of a theoretical or stoichiometric air-fuel ratio Thus, the fuel injection control for an engine is typically achieved by means of an $O_2$ sensor (FIG. 1) for detecting whether the A/F ratio is "rich" (implying a relatively large supply of fuel) or "lean" (implying a relatively small supply of fuel) as compared to the stoichiometric A/F ratio, so that the amount of fuel supplied is corrected based on the detected residual oxygen concentration in the exhaust gas (i.e., the output of the $O_2$ sensor).

In recent years, internal combustion engines have been developed which are capable of controlling the A/F ratio so that the three-way catalyst therein can maintain a constant purification ability. Behind this concept is a fact that a three-way catalyst, which adsorbs oxygen within exhaust gas when the A/F ratio of the exhaust gas is in a lean state and releases the adsorbed oxygen when the A/F ratio of the exhaust gas is in a rich state (such function is referred to as "$O_2$ storage function"), has a limited $O_2$ storage capability. Therefore, in order to allow a three-way catalyst to fully utilize its $O_2$ storage capability, it is essential to maintain the amount of oxygen stored in the catalyst at a predetermined value, e.g., half of its maximum oxygen storage capacity, so that the three-way catalyst is kept ready for an on-coming lean condition or rich condition in the A/F ratio of the exhaust gas. By thus maintaining the amount of oxygen stored in the catalyst at such a predetermined value, the three-way catalyst can exhibit constant $O_2$ adsorbing or releasing capabilities, and hence constant oxidation or reduction capabilities.

Such an internal combustion engine capable of controlling the amount of $O_2$ stored in a catalyst for maintaining the purification capabilities of the catalyst typically employs an A/F ratio sensor. Such an A/F ratio sensor exhibits a characteristic curve as shown in FIG. 2, and is capable of linearly detecting a broad range of A/F ratios including the stoichiometric A/F ratio. Specifically, the A/F ratio sensor is employed for attaining a feedback control which is based on proportional and integral (PI) operations that can be expressed as follows:

$$(\text{Next fuel injection correction amount}) = K_p \times (\text{fuel difference in the current session}) + K_s \times \Sigma(\text{fuel differences in all past sessions})$$

where the term "fuel difference" is defined as:

(the amount of fuel actually burnt within cylinders)—(the target fuel amount to be burnt within cylinders with a stoichiometric amount of air intake), where the term (the amount of fuel actually burnt within cylinders) is defined as (detected air amount)/(detected A/F ratio);

the coefficient $K_p$ represents a gain for the proportional term; and the coefficient $K_s$ represents a gain for the integral term.

Thus, the fuel injection correction amount is constantly calculated in the context of feedback control.

As seen from the above, the equation for calculating the fuel injection correction amount includes a proportional term prefixed by the coefficient $K_p$ and an integral term prefixed by the coefficient $K_s$. The proportional term is a component for maintaining the A/F ratio at the stoichiometric A/F ratio, whereas the integral term is a component for eliminating an offset The integral term serves to maintain the amount of $O_2$ stored in the catalyst at a constant value. For example, if lean gas is generated in response to an abrupt acceleration, the integral term causes rich gas to be generated so as to cancel the effect of the lean gas.

As described above, the A/F ratio feedback control which is based on the output voltage of an A/F ratio sensor is performed so as to increase the fuel injection correction amount as an offset of the output voltage from a target voltage (i.e., a voltage corresponding to the stoichiometric A/F ratio) increases. However, as the A/F ratio sensor deteriorates due to the heat of the exhaust gas and/or the poisonous effects of the lead component, phosphorus component, etc. within the fuel and/or lubrication oil, the response characteristics (i.e., reaction speed at which the sensor can follow actual changes in the A/F ratio) of the A/F ratio sensor decreases, thereby making it difficult to achieve the desired A/F ratio feedback control.

A conventional device for detecting the deterioration of an A/F ratio sensor is disclosed in, for example, Japanese Laid-Open Patent Publication No. 5-106486. The disclosed device for determining the deterioration of an A/F ratio sensor relies on the output of an A/F ratio sensor that is capable of continuously detecting the A/F ratio, which may take any value within a broad range of A/F ratios including the stoichiometric value. The device learns respective feedback correction mounts for a target A/F ratio set at the stoichiometric A/F ratio and for a target A/F ratio set at a value different from the stoichiometric A/F ratio (e.g., a lean A/F ratio) based on the output of the A/F ratio sensor, and determines the deterioration of the A/F ratio sensor based on a difference between the respective learned values.

Since the above-described conventional device for detecting the deterioration of an A/F ratio sensor must learn the feedback correction amounts associated with different target A/F ratios (i.e., the stoichiometric value and another value) and compare the learned values, there is a disadvantage in that the deterioration determination often takes a long times Furthermore, the determination of A/F ratio sensor deterioration by the conventional device is only applicable to an A/F ratio control system whose control is directed to both the stoichiometric A/F ratio and another A/F ratio, erg., a lean A/F ratio. That is, the conventional device is not applicable to a system where the A/F ratio is always controlled toward one target A/F ratio (erg., the stoichiometric A/F ratio). Moreover, the conventional device relies on the fact that a relatively large fluctuation occurs in the output of deteriorated A/F ratio sensors while performing an A/F control on the lean side (as opposed to the stoichiometric A/F ratio) That is, the determination is dependent on the deterioration or fluctuation that occurs in only a limited control range of the A/F ratio sensor, thereby making it difficult to provide a stable determination of deterioration.

SUMMARY OF THE INVENTION

A device for determining deterioration of an air-fuel ratio sensor according to the present invention includes: an air-fuel ratio sensor provided in an exhaust passage of an internal combustion engine, the air-fuel ratio sensor being capable of continuously detecting a broad range of air-fuel ratios including a stoichiometric air-fuel ratio; air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine; variation cumulative value calculation means for cumulating, while the air-fuel ratio feedback control is being performed by the air-fuel ratio feedback control means, a variation $\Delta FT$ in a fuel injection correction amount, thereby calculating a cumulative variation value $\Sigma\Delta FT$ for a predetermined period; and deterioration determination means for determining that the air-fuel ratio sensor is deteriorated when the cumulative variation value $\Sigma\Delta FT$ calculated by the variation cumulative value calculation means exceeds a predetermined value.

Alternatively, the device for determining deterioration of an air-fuel ratio sensor according to the present invention includes: an air-fuel ratio sensor provided in an exhaust passage of an internal combustion engine, the air-fuel ratio sensor being capable of continuously detecting a broad range of air-fuel ratios including a stoichiometric air-fuel ratio; air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine; output cumulative value calculation means for cumulating, while the air-fuel ratio feedback control is being performed by the air-fuel ratio feedback control means, an absolute value of output of the air-fuel ratio sensor or a difference between the output of the air-fuel ratio sensor and the target output, thereby calculating a cumulative output value $\Sigma V$ for a predetermined period; and deterioration determination means for determining that the air-fuel ratio sensor is deteriorated when the cumulative output value $\Sigma V$ calculated by the output cumulative value calculation means exceeds a predetermined value.

Alternatively, the device for determining deterioration of an air-fuel ratio sensor according to the present invention includes: an air-fuel ratio sensor provided in an exhaust passage of an internal combustion engine, the air-fuel ratio sensor Hieing capable of continuously detecting a broad range of air-fuel ratios including a stoichiometric air-fuel ratio; air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine; variation cumulative value calculation means for cumulating, while the air-fuel ratio feedback control is being performed by the air-fuel ratio feedback control means, a variation $\Delta V$ in output of the air-fuel ratio sensor, thereby calculating a cumulative variation value $\Sigma\Delta V$ for a predetermined period; and deterioration determination means for determining that the air-fuel ratio sensor is deteriorated when the cumulative variation value $\Sigma\Delta V$ calculated by the variation cumulative value calculation means exceeds a predetermined value.

Alternatively, the device for determining deterioration of an air-fuel ratio sensor according to the present invention includes: an air-fuel ratio sensor provided in an exhaust passage of an internal combustion engine, the air-fuel ratio sensor being capable of continuously detecting a broad range of air-fuel ratios including a stoichiometric air-fuel ratio; air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine; variation cumulative value calculation means for cumulating, while the air-fuel ratio feedback control is being performed by the air-fuel ratio feedback control means, a variation $\Delta FT$ in a fuel injection correction amount and a variation $\Delta V$ in output of the air-fuel ratio sensor, thereby respectively calculating a cumulative variation value $\Sigma\Delta FT$ and a cumulative variation value $\Sigma\Delta V$ for a predetermined period; and deterioration determination means for determining if the air-fuel ratio sensor is deteriorated based on a ratio between the cumulative variation value $\Sigma\Delta FT$ and the cumulative variation value $\Sigma\Delta V$ calculated by the variation cumulative value calculation means.

Alternatively, the device for determining deterioration of an air-fuel ratio sensor according to the present invention includes: an air-fuel ratio sensor provided in an exhaust passage of an internal combustion engine, the air-fuel ratio sensor being capable of continuously detecting a broad range of air-fuel ratios including a stoichiometric air-fuel ratio; air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine; variation cumulative value calculation means for cumulating, while the air-fuel ratio feedback control is being performed by the air-fuel ratio feedback control means, output V of the air-fuel ratio sensor and a variation $\Delta V$ in the output of the air-fuel ratio sensor, thereby respectively calculating a cumulative output value $\Sigma V$ and a cumulative variation value $\Sigma\Delta V$ for a predetermined period; and deterioration determination means for determining if the air-fuel ratio sensor is deteriorated based on a ratio between the cumulative output value $\Sigma V$ and the cumulative variation value $\Sigma\Delta V$ calculated by the variation cumulative value calculation means.

In one embodiment of the invention, the device for determining the deterioration of an air-fuel ratio sensor further includes variation cumulative value calculation means for cumulating, while the air-fuel ratio feedback control is being performed by the air-fuel ratio feedback control means, a variation $\Delta FT$ in a fuel injection correction amount and a variation $\Delta V$ in output of the air-fuel ratio sensor, thereby respectively calculating a cumulative variation value $\Sigma\Delta FT$ and a cumulative variation value $\Sigma\Delta V$ for a predetermined period, wherein the deterioration determination means determines if the air-fuel ratio sensor is deteriorated based on a ratio between the cumulative output value ΣV and the cumulative variation value ΣΔV and a ratio between the cumulative variation value ΣΔFT and the cumulative variation value ΣΔV.

In another embodiment of the invention, the deterioration determination means determines if the air-fuel ratio sensor is deteriorated based on a product of a ratio between the cumulative output value ΣV and the cumulative variation value ΣΔV and a ratio between the cumulative variation value ΣΔFT and the cumulative variation value ΣΔV.

Thus, in an A/F ratio control apparatus employing an A/F ratio sensor capable of continuously detecting an A/F ratio in a broad range of values including the stoichiometric A/F ratio, the invention described herein advantageously provides a device for achieving the early detection of the deterioration of the A/F ratio sensor without relying on the sensor characteristics outside the control range for the stoichiometric value.

This and other advantages of the present invention will become apparent to those skilled in the art upon reading and understanding the following detailed description with reference to the accompanying figures.

BRIEF DESCRIPTION OF THE DRAWINGS

FIG. 6 is a diagram showing estimated inner-cylinder air amounts relative to calculated target inner-cylinder fuel amounts.

FIG. 18 is a flow diagram illustrating the A/F ratio sensor OUTPUT DETERIORATION (MALFUNCTIONING) DETERMINATION routine for determining the deterioration of an A/F ratio sensor output according to Example 4 of the present invention.

DESCRIPTION OF THE PREFERRED EMBODIMENTS

Figure 1:
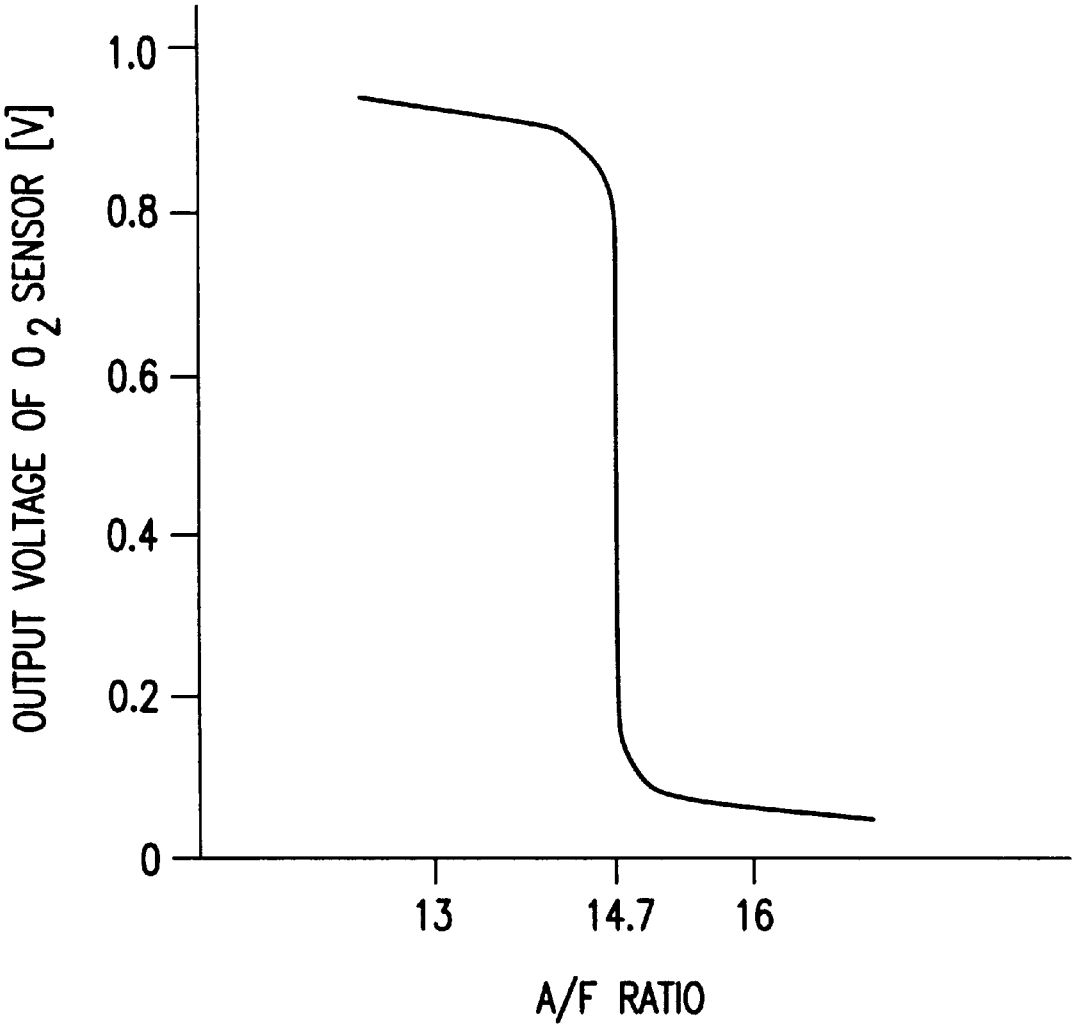
FIG. 1 is a graph illustrating the relationship between an A/F ratio and an output voltage of an $O_2$ sensor.

Hereinafter, the present invention will be described by way of illustrative examples, with reference to the accompanying figures.

First, an exemplary internal combustion engine, to which the A/F ratio sensor deterioration detection device according to the invention is applicable, will be briefly described. FIG.

3 shows an electronically-controlled internal combustion engine 10 incorporating an A/F ratio sensor and an A/F ratio control device, where the A/F ratio sensor is to be tested for deterioration by the A/F ratio sensor deterioration detection device according to the present invention.

Air required for the combustion in the engine is filtered through an air cleaner 2, passed through a throttle body 4, and routed into the air intake tubes of the respective cylinders via a surge tank (intake manifold) 6. The flow amount of the air intake is adjusted by means of a throttle valve 5 provided on the throttle body 4 and measured by an airflow meter 40. The temperature of the air intake is detected by an air intake temperature sensor 43. The pressures within the air intake tubes are detected by a vacuum sensor 41.

The degree of opening of the throttle valve 5 is detected by a throttle opening degree sensor 42. When the throttle valve 5 is in a fully-close state, an idling switch 52 is turned on so that its output, i.e., a throttle-closed signal becomes active. An idling rotation speed control valve (ISCV) 66 is provided in an idling adjustment passage 8 which by-passes the throttle valve 5. The idling rotation speed control valve (ISCV) 66 adjusts the flow of air during idling.

Fuel stored in a fuel tank 10 is pumped by a fuel pump 11 into a fuel pipe 12 so as to be injected into each air intake tube 7.

The fuel is mixed with air within the air intake tube 7. The gaseous mixture is sucked into a combustion chamber 21 of each cylinder 20 (which essentially constitutes the body of the engine) via an air intake valve 24. In the combustion chamber 21, the gaseous mixture is first compressed by means of a piston 23 and then ignited to explode into combustion, whereby kinetic energy is generated. Specifically, the ignition process proceeds as follows: an ignitor 62, receiving an ignition signal, controls the supply of a primary electric current to an ignition coil 63 so that the secondary electric current of the ignition coil 63 is supplied to a spark plug 65 via an ignition distributor 64.

The ignition distributor 64 includes a reference position detection sensor 50 and a crank angle sensor 51. The reference position detection sensor 50 generates a reference position detection pulse for every rotation angle (of the distributor axis) that corresponds to a crank angle (CA) of 720°. The crank angle sensor 51 generates a position detection pulse for every rotation angle (of the distributor axis) that corresponds to 30° CA. The actual velocity of the automobile is detected by a speed sensor 53 which generates output pulses indicating the velocity of the automobile. The engine body (cylinder(s)) 20 is cooled by cooling water introduced into a passage 22. The temperature of the cooling water is detected by a water temperature sensor 44.

The gaseous mixture after combustion is led into an exhaust manifold 30 via an exhaust valve 26 (as exhaust gas) and subsequently into an exhaust tube 34. Attached to the exhaust tube 34 is an A/F ratio sensor 45 for linearly detecting the A/F ratio based on the oxygen concentration within the exhaust gas. Further downstream of the exhaust tube 34, the exhaust system includes a catalytic convertor 38 which accommodates a three-way catalyst for promoting the oxidation of the unburnt components (HC and/or CO) as well as the reduction of nitrogen oxides ($NO_x$). The exhaust gas is discharged into the atmosphere only after being purified by the catalytic convertor 38.

The exemplary engine performs an A/F ratio sub-feedback control to vary the center of A/F ratio feedback control made with the A/F ratio sensor 45. Downstream of the catalytic convertor 38 is provided an $O_2$ sensor 46. The $O_2$ sensor 46 is preferable, but not essential to the present invention.

Figure 4:
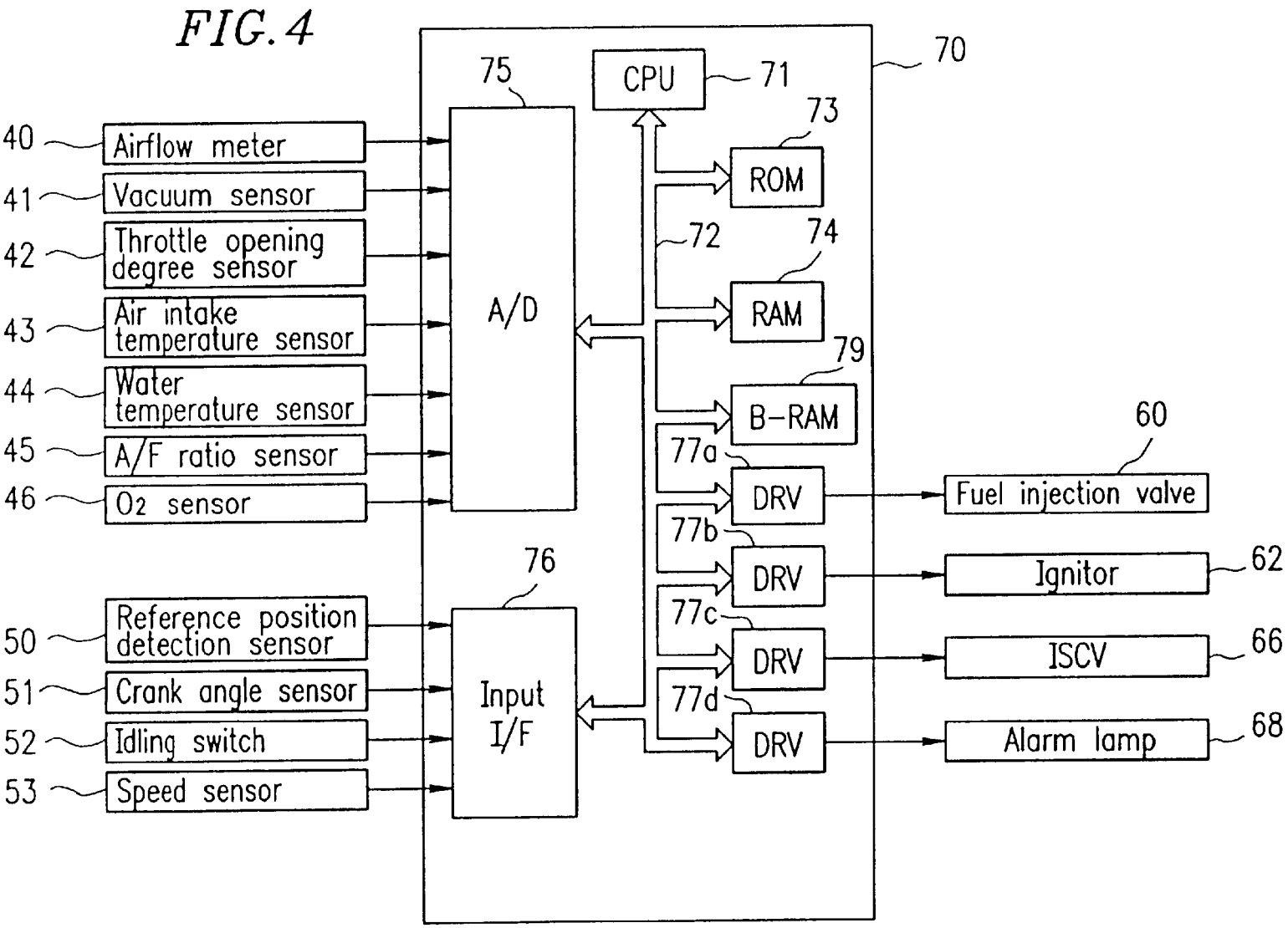
FIG. 4 is a block diagram showing an exemplary hardware structure of an engine ECU (electronics control unit) of the electronically-controlled internal combustion engine shown in FIG. 3.

An engine electronics control unit (hereinafter referred to as the "engine ECU") 70 is a microcomputer system for performing various controls, e.g., fuel injection control (A/F ratio control), ignition timing control, and idling rotation speed control, as well as determination of the deterioration of the response characteristics of the A/F ratio sensor. FIG. 4 is a block diagram showing an exemplary hardware structure of the engine ECU 70. In accordance with programs and various maps stored in a ROM (read only memory) 73, a CPU (central processing unit) 71 receives signals from various sensors 40 to 46 and switches 50 to 53 via an A/D convertor circuit 75 or an input interface circuit 76, performs calculations based on such input signals, and outputs control signals for various actuators based on the calculation results via drive control circuits 77*a* to 77*d*. A RAM (random access memory) 74 is used as a temporary data storage means during the calculation/control process. A backup RAM 79 is directly coupled to a battery (not shown) for power supply, so that the RAM 79 can retain necessary data (e.g., various learned values) even while the ignition switch is turned off. The component elements of the engine ECU 70 are interconnected via system buses 72 including address buses, data buses, and control buses.

Hereinafter, an engine control process performed by the engine ECU 70 in an internal combustion engine having the above-described hardware configuration will be described.

Ignition timing control includes determining the overall state of the engine based on signals from various sensors (erg., an engine rotation speed signal from the crank angle sensor 52), deciding the optimum moment for ignition, and sending an ignition signal to the ignitor 62 via the drive control circuit 77*b*.

Idling rotation speed control includes detecting an idling state based on a throttle-closed signal from the idling switch 52 and a speed signal from the speed sensor 53, comparing the target rotation speed (which is determined by factors such as the engine cooling water temperature signal from the water temperature sensor 44) with the actual engine rotation speed, determining a control amount for achieving the target rotation speed based on the difference between the two, and adjusting the amount of air flow by controlling the ISCV 66 via the drive control circuit 77*c*. As a result of this control, the optimum idling rotation speed is maintained.

For the sake of describing an A/F ratio control (fuel injection control) system to which the present invention is applicable and describing a process for detecting the response characteristics of an A/F ratio sensor according to the present invention, the procedures of a few related routines are first described below.

Figure 5:
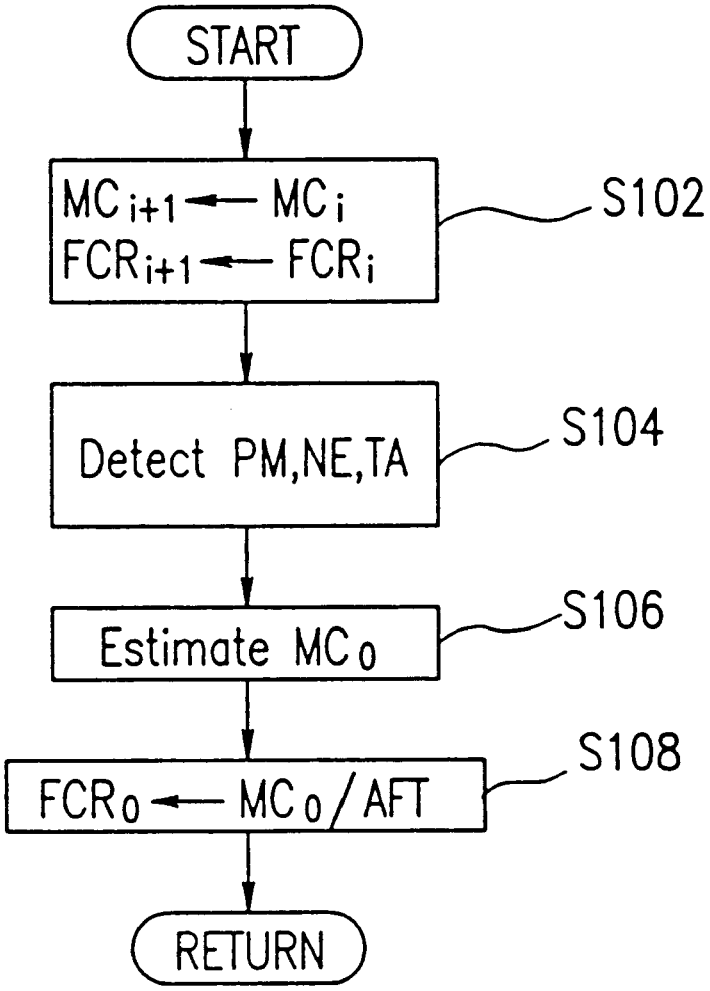
FIG. 5 is a flow diagram illustrating the procedure of an INNER-CYLINDER AIR AMOUNT ESTIMATION AND TARGET INNER-CYLINDER FUEL AMOUNT CALCULATION routine.

FIG. 5 is a flow diagram illustrating the procedure of an INNER-CYLINDER AIR AMOUNT ESTIMATION AND TARGET INNER-CYLINDER FUEL AMOUNT CALCULATION routine, which is executed for every predetermined degrees of the crank angle. First, the air amount $MC_i$ within the relevant cylinder that has been obtained up to the previous call (execution) of this routine and the target inner-cylinder fuel amount $FCR_i$ are both updated Specifically, at step S102, the $MC_i$ and $FCR_i$ from i calls (of the routine) ago are newly regarded as $MC_{i+1}$ and $FCR_{i+1}$ from i+1 calls ago (where i=0, 1, . . . , n−1). This update is made in order to store the values of the innercylinder air amount $MC_i$ and the target inner-cylinder fuel amount $FCR_i$ for the past n calls of the routine into the RAM 74, and to further calculate $MC_0$ and $FCR_0$ as part of the current routine.

Next, at step S104, the current pressure PM of the air intake tube, the current rotation speed NE of the engine, and the current throttle opening TR are calculated based on the outputs from the vacuum sensor 41, the crank angle sensor 52, and the throttle opening degree sensor 42. Then the inner-cylinder air amount $MC_0$, i.e., the amount of air being supplied into the cylinder, is estimated based on the data of PM, NE, and TA (step S106). Although it is generally possible to estimate the inner-cylinder air amount based on PM and NE, the present example further monitors the changes in TA in order to detect a transition state, so that the air amount can be accurately calculated even during transition states.

Next, based on the inner air amount $MC_0$ and the stoichiometric A/F ratio value AFT, the target fuel amount $FCR_0$, which should ideally be supplied into the cylinder to attain a stoichiometric A/F ratio of the gaseous mixture, is derived as follows at step S108:

$$FCR_0 \leftarrow MC_0/AFT$$

The inner air amount $MC_0$ and the target fuel amount $FCR_0$ thus obtained are stored in the RAM 74 as the latest data (i.e., obtained during the current call of the routine) in the format shown in FIG. 6.

Next, an A/F RATIO FEEDBACK CONTROL routine and a FUEL INJECTION ROUTINE will be described.

Figure 7:
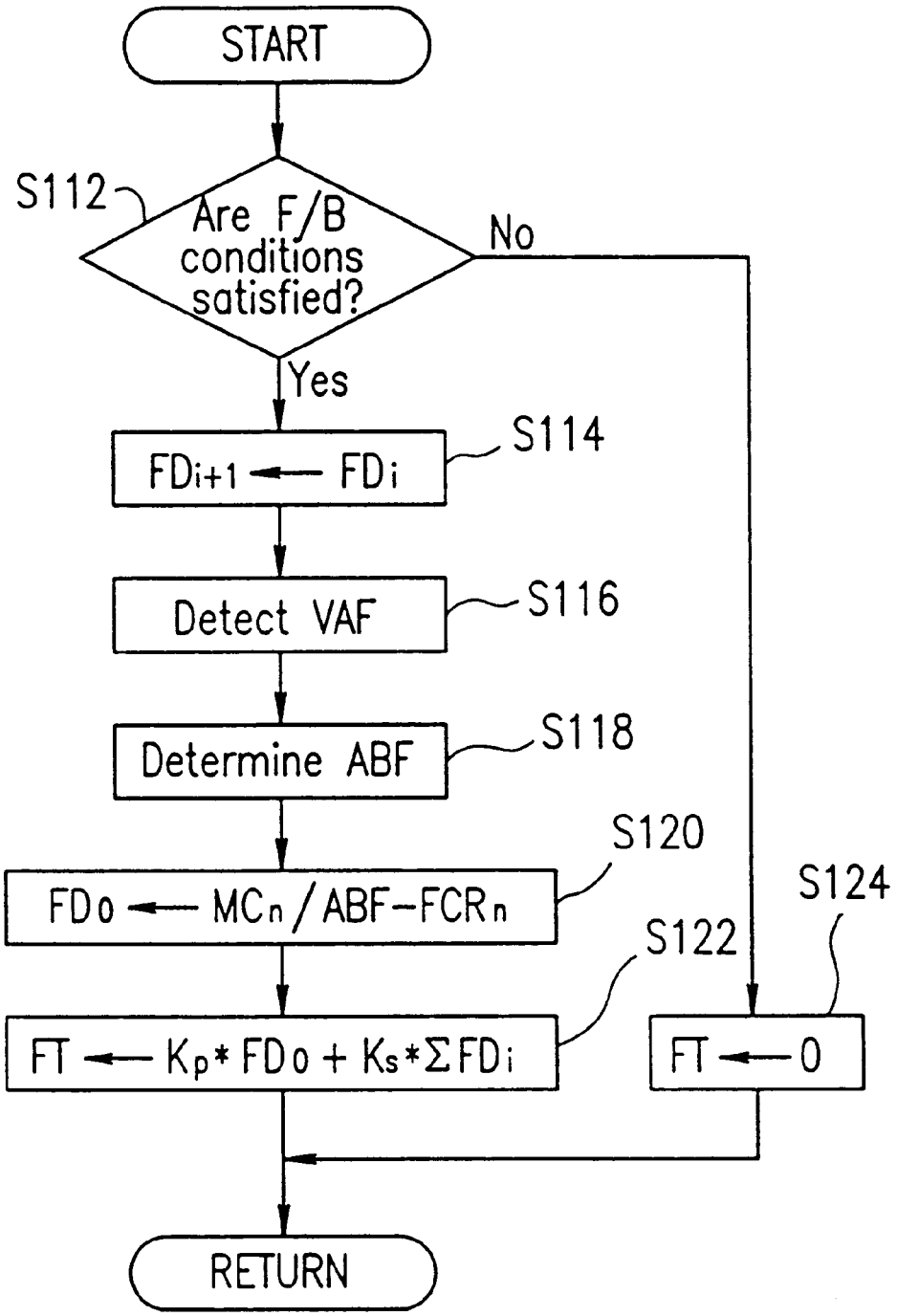
FIG. 7 is a flow diagram illustrating the procedure of the A/F RATIO FEEDBACK CONTROL routine.

FIG. 7 is a flow diagram illustrating the procedure of the A/F RATIO FEEDBACK CONTROL routine, which is executed for every predetermined degrees of the crank angle. First, at step S112, it is determined whether or not the conditions for permitting the execution of feedback control (hereinafter referred to as "feedback control-permitting conditions") are satisfied. For example, the feedback control-permitting conditions may not be satisfied during periods of excessively low temperature of the cooling water, starting the engine, periods of increased fuel usage after the engine is started, periods of increased usage of fuel for warming-up the engine, absence of changes in the output signal of the A/F ratio sensor 45, and/or periods of reduced fuel usage; otherwise the feedback control-permitting conditions are considered as being satisfied. If the feedback control-permitting conditions are not satisfied, the fuel injection correction amount FT through feedback control is set at 0 at step S124 and this routine is ended.

If the feedback control-permitting conditions are satisfied, the fuel difference $FD_1$ (i.e., the difference between the amount of fuel actually burnt within the cylinder and the target inner-cylinder fuel amount), which has been obtained up to the previous call of this routine, is updated Specifically, at step S114, the $FD_i$ from i calls (of the routine) ago are newly regarded as the $FD_{i+1}$ from i+1 calls ago (where i=0, 1, . . . , m−1). This update is made in order to store the value of the fuel difference $FD_i$ for the past m calls of the routine into the RAM 74, and to further calculate $FD_0$ as part of the current routine.

Figure 2:
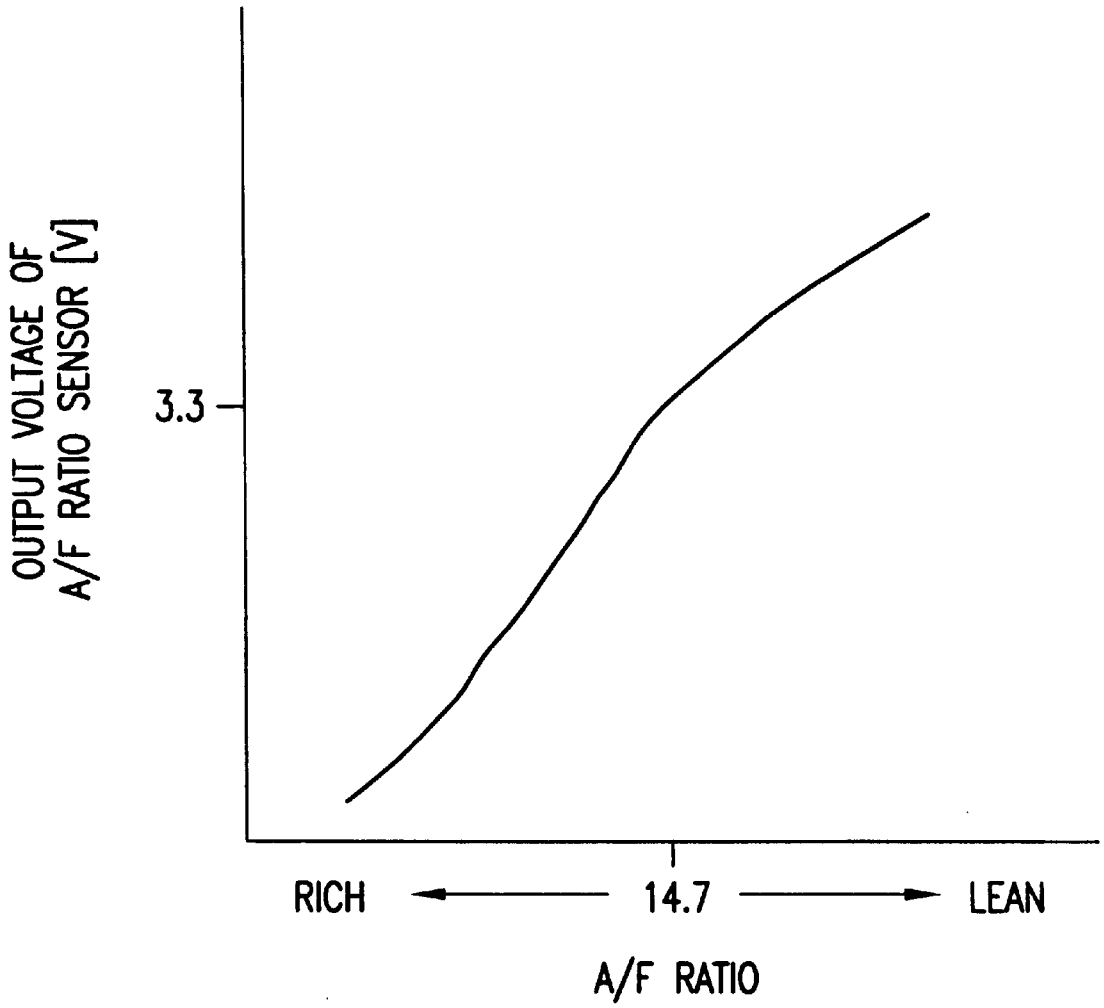
FIG. 2 is a graph illustrating the relationship between an A/F ratio and an output voltage of A/F ratio sensor.

Next, at step S116, the output voltage VAF of the A/F ratio sensor 45 is detected. Then, by referring to the characteristic curve of FIG. 2 based on the output voltage VAF, the current A/F ratio value ABF is determined at step S1180 The characteristic curve of FIG. 2 is previously stored in the ROM 73 in the form of a map.

Next, based on the inner air amount $MC_n$ and the target fuel amount $FCR_n$ (see FIG. 6) already calculated through the INNER-CYLINDER AIR AMOUNT ESTIMATION AND TARGET INNER-CYLINDER FUEL AMOUNT CALCULATION routine, the difference between the amount of fuel actually burnt within the cylinder and the target inner-cylinder fuel amount is derived as follows at step S120:

$$FD_0 \leftarrow MC_n/ABF - FCR_n$$

The reason for employing the values of the inner-cylinder air amount $MC_n$ and the target inner-cylinder fuel amount $FCR_n$ from n calls ago is that there is a lapse of time between the moment of detection of the A/F ratio by the A/F ratio sensor 45 and actual combustion. Such a time difference makes it is necessary to store the values of the inner-cylinder air amount $MC_i$ and the target inner-cylinder fuel amount $FCR_i$ for the past n calls.

Next, at step S122, a fuel injection correction amount FT is derived by a proportional-integral control (hereinafter referred to as "PI control") as follows:

$$FT \leftarrow K_p \times FD_0 + K_s \times \Sigma FD_i$$

The first term on the right side of the equation is a proportional term of the PI control, where the coefficient $K_p$ represents a gain for the proportional term. The second term on the right side of the equation is an integral term of the PI control, where the coefficient $K_s$ represents a gain for the integral term.

Figure 8:
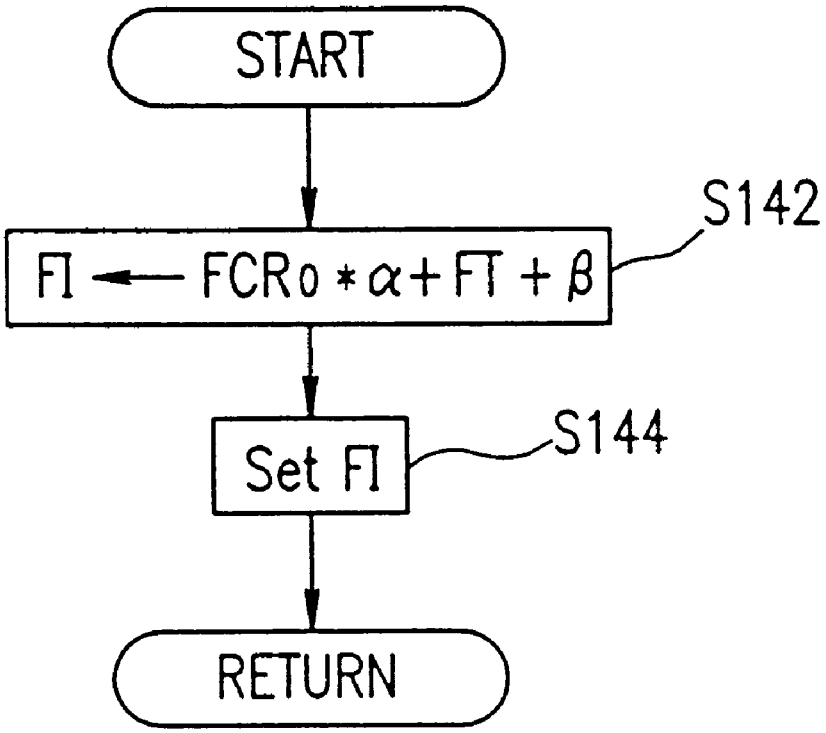
FIG. 8 is a flow diagram illustrating the procedure of the FUEL INJECTION CONTROL routine.

FIG. 8 is a flow diagram illustrating the procedure of the FUEL INJECTION CONTROL routine, which is executed for every predetermined degrees of the crank angle. First, based on the target fuel amount $FCR_n$ already calculated through the INNER-CYLINDER AIR AMOUNT ESTIMATION AND TARGET INNER-CYLINDER FUEL AMOUNT CALCULATION routine and on the fuel injection correction amount already calculated through the A/F RATIO FEEDBACK CONTROL routine, a fuel injection amount FI is derived as follows, at step S142:

$$FI \leftarrow FCR_0 \times \alpha + FT + \beta$$

α and β represent, respectively, a correction amount for a multiplicative correction coefficient and an additive correction amount. The values of α and β are determined by other parameters indicating the operation state. For example, α includes fundamental corrections based on the signals from sensors such as the air intake temperature sensor 43 and the water temperature sensor 44, whereas β includes a correction based on changes in the amount of fuel adhered on the walls of the cylinders, which may vary in accordance with the air intake tube pressure during a transition operation. Finally, the fuel injection amount FI thus obtained is set in the drive control circuit 77*a* for the fuel injection valve 60.

Although the above description is directed to a case where the feedback control is performed based on the output from the A/F ratio sensor 45 provided upstream of the catalyst, it is also possible to perform a secondary A/F ratio feedback control based on the output from the $O_2$ sensor 46 provided downstream of the catalyst. In that case, the output voltage VAF of the A/F ratio sensor upstream of the catalyst can be corrected based on the output from the $O_2$ sensor 46 downstream of the catalyst as follows:

$$VAF \leftarrow VAF + DV$$

In this case, an integration value is to be derived from the value of VAF corrected as above.

Now, the principles of the device according to the present invention for determining the deterioration of an A/F ratio sensor which is employed in an A/F ratio feedback control system for controlling the A/F ratio to a desired value by correcting the fuel injection amount based on a difference between the output from the A/F ratio sensor and the target A/F ratio will be described.

Figure 9A:
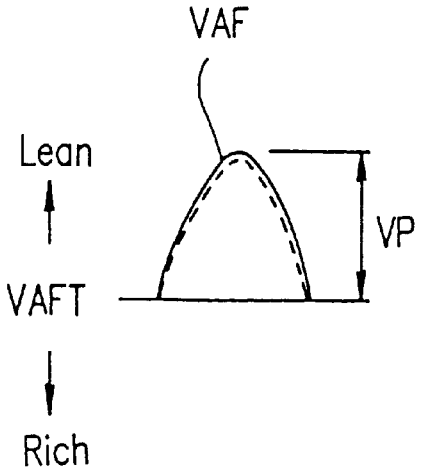
FIG. 9A is a graph schematically illustrating the relationship between an output voltage VAF of an A/F ratio sensor (solid line) and an ideal output voltage of the A/F ratio sensor reflecting the actual A/F ratio (broken line), illustrating an A/F ratio sensor with normal response characteristics.
Figure 9B:
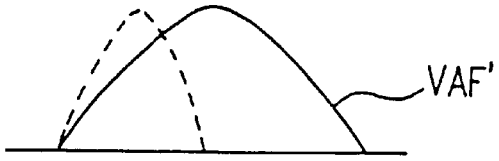
FIG. 9B is a graph schematically illustrating the relationship between an output voltage VAF of an A/F ratio sensor (solid line) and an ideal output voltage of the A/F ratio sensor reflecting the actual A/F ratio (broken line), illustrating an A/F ratio sensor with deteriorated response characteristics.

FIGS. 9A and 9B are graphs schematically illustrating the relationship between an output voltage VAF of an A/F ratio sensor (solid line) and an ideal output voltage of the A/F ratio sensor reflecting the actual A/F ratio (broken line). FIG. 9A illustrates an A/F ratio sensor with normal response characteristics (defined herein as "high-response characteristics"), whose output VAF is substantially a voltage that ideally reflects the actual A/F ratio. FIG. 9B illustrates an A/F ratio sensor with deteriorated response characteristics (defined herein as "low-response characteristics"), whose output VAF' poorly follows the voltage ideally reflecting the actual A/F ratio. As exemplified in FIG. 9B, the phase of the output VAF' of the low-response A/F ratio sensor may lag behind the phase of the out-put VAF of the high-response A/F ratio sensor. In FIG. 9A, the offset of the output VAF of the high-response A/F ratio sensor from the target voltage (stoichiometric voltage) VAFT is expressed as an amplitude VP.

The A/F ratio feedback control is performed so that the fuel injection correction amount is increased as the offset of the output voltage VAF from the target voltage VAFT, corresponding to the stoichiometric A/F ratio (i.e., the amplitude VP of VAF with respect to VAFT) increases. For example, a fundamental fuel amount may be calculated by correcting (based on air intake temperature, etch) a target inner-cylinder fuel amount $VCR_0$, which is calculated based on the inner-cylinder air amount $MC_0$ and the stoichiometric A/F ratio AFT. Then, an A/F ratio of the actual exhaust gas, as measured by the A/F ratio sensor 45, can be compared against this fundamental fuel amount, whereby a feedback correction which is in accordance with the offset from the stoichiometric A/F ratio can be made.

Figures 10A, 10B:
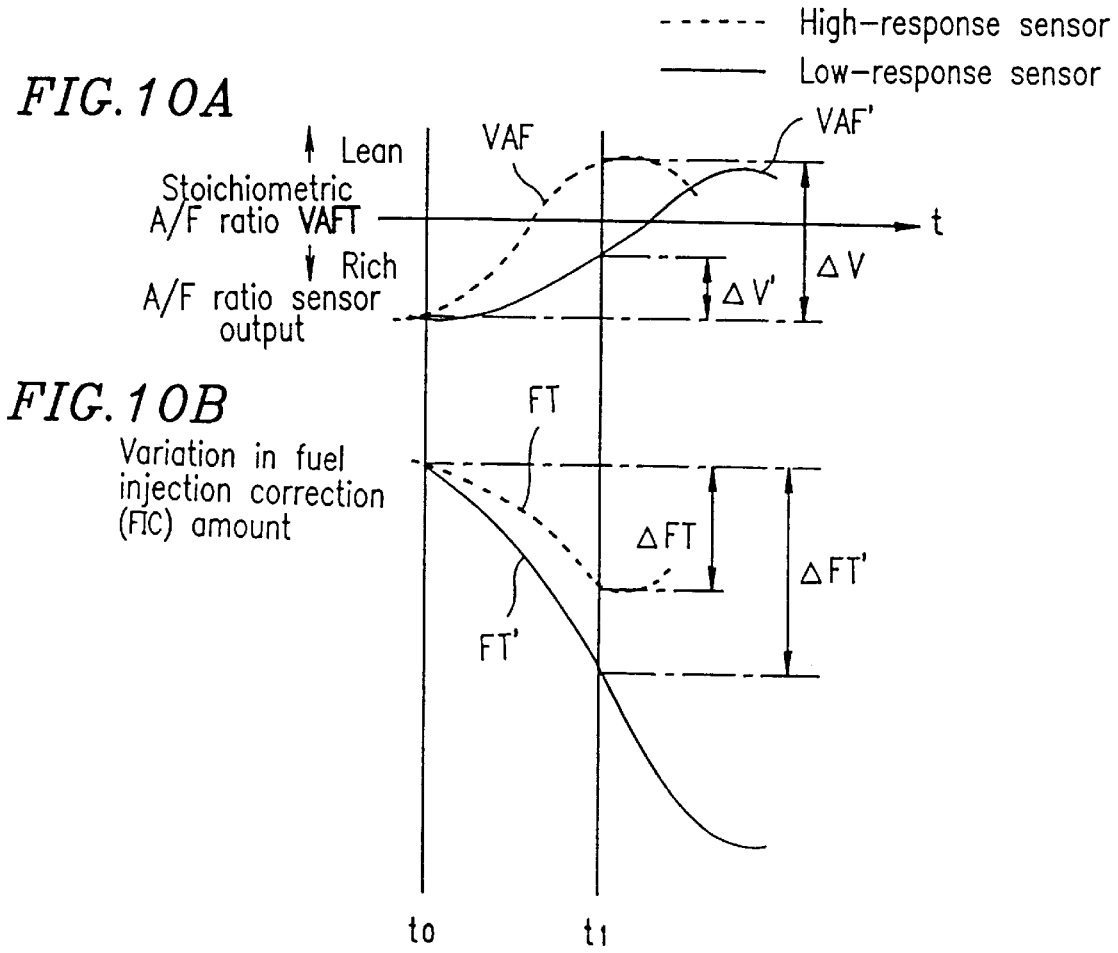
FIG. 10A illustrates the output VAF of a high-response A/F ratio sensor (broken line) and the out-put VAF' of a low-response A/F ratio sensor (solid line).
FIG. 10B illustrates exemplary feedback corrections performed for the fuel injection amount (FIC).

FIGS. 10A and 10B illustrate an exemplary feedback correction to be performed for the fuel injection amount. FIG. 10A illustrates the output VAF of a high-response A/F ratio sensor (broken line) and the output VAF' of a low-response A/F ratio sensor (solid line) against time (the axis of abscissas). The fuel injection correction amount FT or FT' shown in FIG. 10B corresponds to the feedback correction for the fundamental injection amount as mentioned above As shown in FIG. 10B, the high-response A/F ratio sensor can provide a feedback correction (FT) based on the output VAF which accurately reflects the voltage corresponding to the actual A/F ratio On the other hand, the low-response A/F ratio sensor provides a feedback correction (FT') based on its deteriorated characteristics, e.g., the output VAF' whose phase lags behind the voltage corresponding to the actual A/F ratio.

As shown in FIG. 10A, the feedback control starting from time $t_0$ typically proceeds as follows: The output VAF of the high-response A/F ratio sensor, which accurately reflects the voltage corresponding, to the actual A/F ratio, gradually increases from the rich side (with its amplitude gradually decreasing), exceeds the stoichiometric A/F ratio VAFT (with its amplitude being zero), continues increasing on the lean side (with its amplitude increasing), and again decreases past time $t_1$ (with its amplitude decreasing) The fuel injection correction amount FT, as shown in FIG. 10B, keeps decreasing correspondingly, reaches a predetermined correction amount at $t_1$, and then increases again.

In contrast, the output VAF' of the low-response A/F ratio sensor, due to its slow response, is still monotonously increasing (with its amplitude decreasing) even after the output of the high-response A/F ratio sensor has shifted from the rich side to the lean side across the stoichiometric A/F ratio VAFT between time $t_0$ and time $t_1$ in FIG. 10A. Therefore, as shown in FIG. 10B, the fuel injection correction amount FT' continues decreasing past the appropriate correction level although it should already be increasing (which would be the case if the response characteristics of the A/F ratio sensor had not deteriorated, i.e., reflecting the voltage corresponding to the actual A/F ratio) Thus, in the A/F ratio control system described above, once the response characteristics of the A/F ratio sensor have deteriorated from the proper sensor response characteristics intended for the feedback system, an excessive correction may be performed for the fundamental injection amount. For example, as shown in FIG. 10B, the fuel injection correction amount of the low-response A/F ratio sensor between time $t_0$ and time $t_1$ varies by an amount ΔFT', which is substantially larger than the amount ΔFT by which the fuel injection correction amount of the high-response A/F ratio sensor varies during the same period.

As a result, the feedback control with the low-response A/F ratio sensor provides poor convergence to the target A/F ratio value, so that the A/F ratio bounces between excessively rich states and excessively lean states across the target A/F ratio, with the output VAF of the A/F ratio sensor and the fuel injection correction amount per unit time (or a predetermined time interval) greatly varying. By paying attention to this relatively large variation, the present invention provides an accurate detection of the deterioration of the A/F ratio sensor. Specifically, the present invention utilizes, for example, a cumulative value of the variation in the output of the A/F ratio sensor or the fuel injection correction amount taken over a predetermined period of time; the A/F ratio sensor is determined as deteriorated when the cumulative value exceeds a predetermined value.

Figures 11A, 11B:
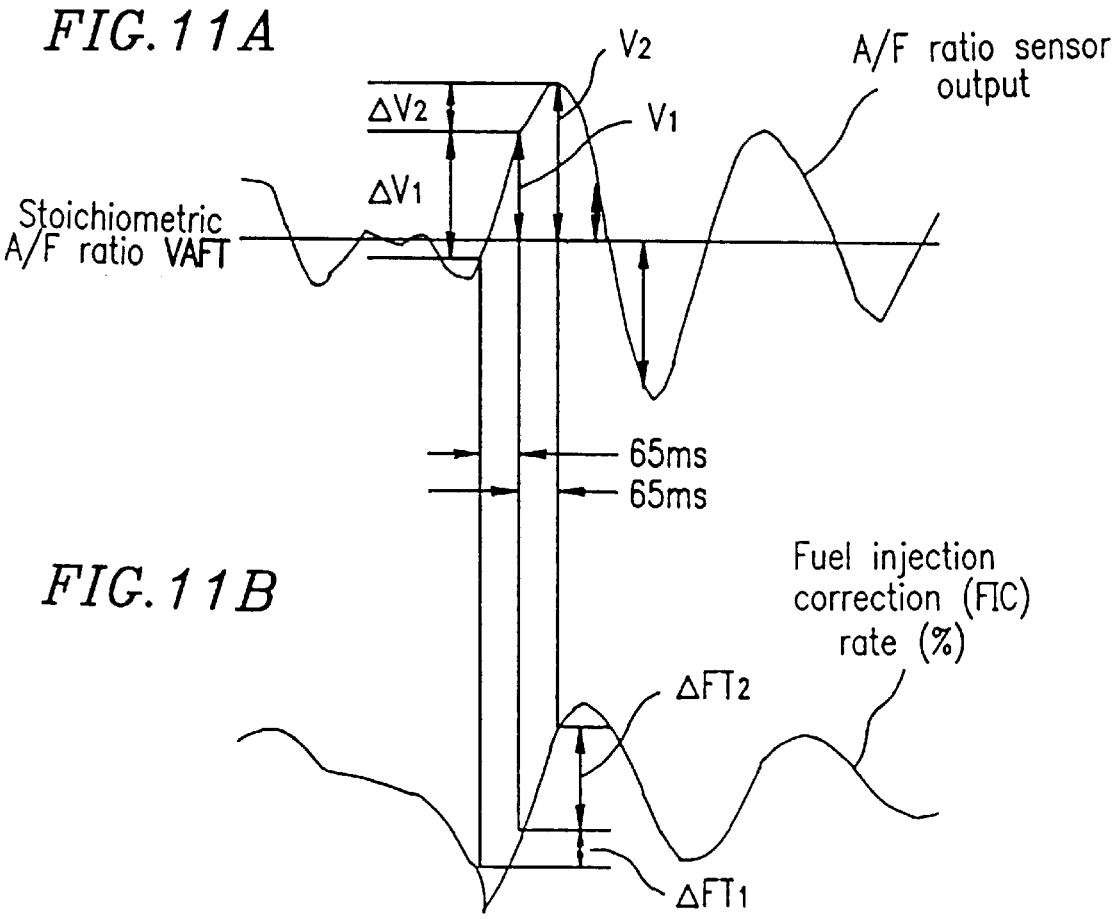
FIG. 11A illustrates an exemplary output of an A/F ratio sensor.
FIG. 11B illustrates an exemplary fuel injection correction (FIC) rate based on a feedback control.

In the following description, the fuel injection correction amount will be represented in terms of a fuel injection correction rate (hereinafter referred to as "FIC rate (%)") representing the rate of correction amount relative to the fundamental injection amount, as illustrated in FIGS. 11A and 11B. FIG. 11A shows the output of an exemplary A/F ratio sensor, and FIG. 11B shows the corresponding FIC rate (%) according to the above-described feedback control. As explained above, a cumulative (or summation) value $S_1=\Sigma\Delta FT_m$, which is obtained by calculating the variation $\Delta FT_m$ in the FIC rate FT at a predetermined time interval and summing all the variation $\Delta FT_m$, becomes larger for a low-response A/F ratio sensor than for a normal or high-response A/F ratio sensor The variation $\Delta FT_1$ and $\Delta FT_2$ shown in FIG. 11B are obtained at a time interval of 65 ms.

Alternatively, either one of the followings can be adopted as an index of deterioration in the response characteristics of an A/F ratio sensor: a cumulative value which is obtained by calculating the offset of the output of the A/F ratio sensor from a target output corresponding to the target A/F ratio at a predetermined time interval and summing all the offsets; and a cumulative value which is obtained by calculating the variation in the output of the A/F ratio sensor at a predetermined time interval and summing all the variation. For example, as shown in FIG. 11A, a cumulative value $S_2=\Sigma V_m$, which is obtained by calculating the offset $V_m$ (m=1, 2, . . . ) of the output of the A/F ratio sensor from a target output VAFT corresponding to the stoichiometric A/F ratio at a predetermined time interval and summing all the off-sets $V_m$, or a cumulative value $S_3=\Sigma\Delta V_n$, which is obtained by calculating the variation $\Delta V_n$ in the output of the A/F ratio sensor at a predetermined time interval and summing all the variation $\Delta V_n$ similarly becomes larger for a low-response A/F ratio sensor than for a normal or high-response A/F ratio sensor. Accordingly, an A/F ratio sensor can be determined as deteriorated when any of these cumulative values exceeds a predetermined value, thereby providing an accurate detection of malfunctioning of the A/F ratio sensor.

Figure 12:
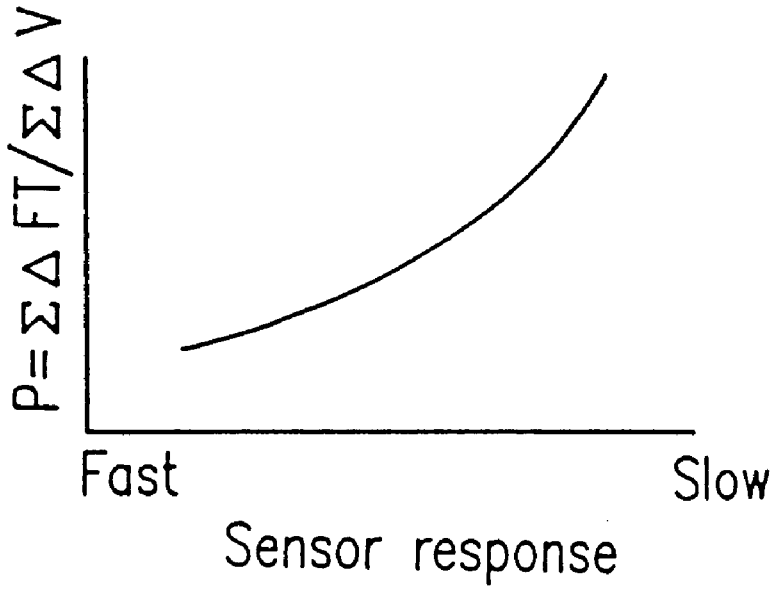
FIG. 12 schematically shows the relationship between the response characteristics of an A/F ratio sensor and P=ΣΔFT/ΣΔV, where ΣΔFT represents a cumulative value of the variation ΔFT in a FIC amount and ΣΔV represents a cumulative value of the variation ΔV in the A/F ratio sensor output.

Alternatively, the following can be adopted as an index of deterioration in the response characteristics of an A/F ratio sensor: Since deterioration in the response characteristics of an A/F ratio sensor causes a decrease in its ability to follow a value obtained by dividing the variation in the FIC rate during a predetermined period by the variation in the output of the A/F ratio sensor during the same period increases as the response characteristics of the A/F ratio sensor deteriorate For example, as shown in FIG. 10A, the variation ΔV' of the low-response A/F ratio sensor between time $t_0$ and time $t_1$ is smaller than the variation ΔV of the high-response A/F ratio sensor during the same period. Therefore, a value P' obtained by dividing the cumulative value ΣΔFT' of the variation ΔFT' in the FIC rate of the low-response A/F ratio sensor between time $t_0$ and time $t_1$ (described above with reference to FIG. 10B) by a cumulative value ΣΔV' of the corresponding variation ΔV' in the low-response A/F ratio sensor output becomes larger than a value P obtained by dividing the cumulative value ΣΔFT of the variation ΔFT in the FIC rate FT of the high-response A/F ratio sensor between time $t_0$ and time $t_1$ by a cumulative value ΣΔV (i.e., $S_3$) of the corresponding variation ΔV in the high-response A/F ratio sensor output. FIG. 12 schematically shows the relationship between the response characteristics of an A/F ratio sensor and a value P=ΣΔFT/ΣΔV (or P'=ΣΔFT'/ΣΔV'). Accordingly, an A/F ratio sensor is determined as deteriorated when the value P=ΣΔFT/ΣΔV (=$S_1/S_3$) exceeds a predetermined value, thereby providing an accurate detection of the malfunctioning of the A/F ratio sensor.

Figure 13A:
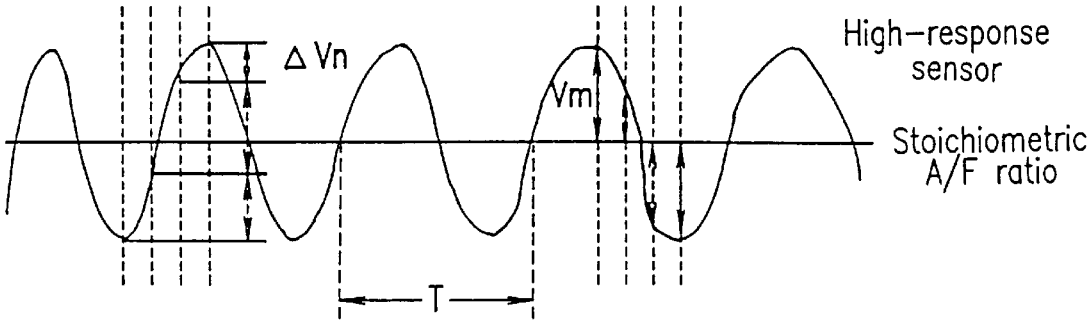
FIG. 13A illustrates the output characteristics of a high-response A/F ratio sensor.
Figure 13B:
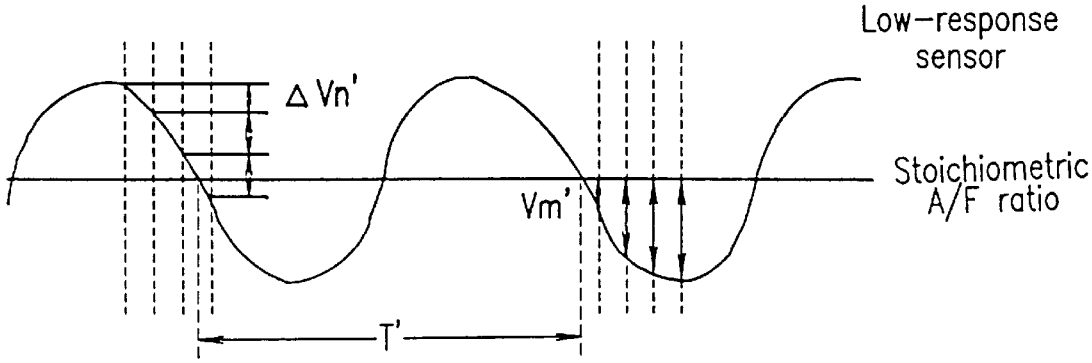
FIG. 13B illustrates the output characteristics of a low-response A/F ratio sensor.

Alternatively, paying attention to the geometrical characteristics of the output waveform of an A/F ratio sensor, an index of deterioration in the response characteristics of an A/F ratio sensor can be derived from a cumulative value of the A/F ratio sensor output and a cumulative value of the variation in the A/F ratio sensor output. As shown in FIGS. 13A and 13B, the cumulative value $S_3=\Sigma\Delta V_n$ of the variation in the output of the A/F ratio sensor is in proportion with both the frequency of variation and the output amplitude of the output of the A/F ratio sensor. On the other hand, the cumulative value $S_2=\Sigma V_m$ of the offset of the output of the A/F ratio sensor from a target output corresponding to the stoichiometric A/F ratio is substantially in proportion with the output amplitude but relatively independent from the frequency of variation Therefore, a value Q which is obtained by dividing the cumulative value $S_2=\Sigma V_m$ of the offset of the output of the A/F ratio sensor from the target output corresponding to the stoichiometric A/F ratio by the cumulative value $S_3$ of the variation in the output of the A/F ratio sensor (i.e., $Q=S_2/S_3=\Sigma V_m/\Sigma\Delta V_n$) is in inverse proportion with the variation frequency of the output of the A/F ratio sensor, with the influence of the amplitude of the A/F ratio sensor output being removed. That is, the value $Q=\Sigma V_m/\Sigma\Delta V_n$ is in proportion with the variation cycle T (or T').

Figure 14:
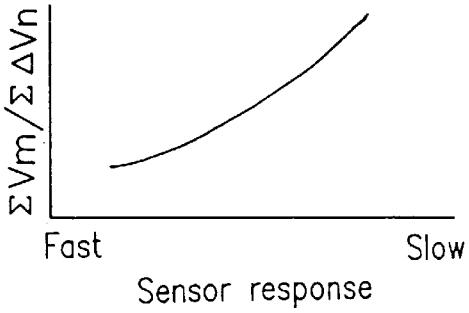
FIG. 14 schematically shows the relationship between the response characteristics of an A/F ratio sensor and a ratio ΣVm/ΣΔVn, where ΣVm represents a cumulative value of the absolute values of the A/F ratio sensor output and ΣΔVn represents a cumulative value of the variation ΔVn in the A/F ratio sensor output.

As seen from FIGS. 13A and 13B, the variation cycle T (or T') of the output of the A/F ratio sensor depends on the response characteristics of the A/F ratio sensor. Therefore, the value $Q=\Sigma V_m/\Sigma\Delta V_n$, i.e., the ratio of the cumulative output of an A/F ratio sensor and cumulative variation in the output of the A/F ratio sensor increases as the response characteristics of the A/F ratio sensor deteriorate. This relationship is schematically shown in FIG. 14. Accordingly, an A/F ratio sensor is determined as deteriorated when the value $Q=\Sigma V_m/\Sigma\Delta V_n$ exceeds a predetermined value, thereby providing an accurate detection of the malfunctioning of the A/F ratio sensor.

The above-described indices P and Q are each correlated with the response characteristics of an A/F ratio sensor. Therefore, a value R which is obtained by multiplying P by Q (expressed in equation (1) below) is even more clearly correlated with the response characteristics of an A/F ratio sensor.

$$R = PQ = (\Sigma\Delta FT_m / \Sigma\Delta V_n)\cdot(\Sigma V_m / \Sigma\Delta V_n) = (\Sigma\Delta FT_m \cdot \Sigma V_m)/(\Sigma\Delta V_n)^2 \quad \text{eq.(1)}$$

Accordingly, an A/F ratio sensor can be determined as deteriorated when the value R exceeds a predetermined value, thereby providing an accurate detection of the malfunctioning of the A/F ratio sensor.

Thus, the deterioration of an A/F ratio sensor can be detected by utilizing one or any combination of the above-mentioned indices Furthermore, it becomes possible to detect the early deterioration in the A/F ratio controllability due to the deteriorated characteristics of the A/F ratio sensor output and to prevent consequent aggravation of the exhaust emissions.

Figure 3:
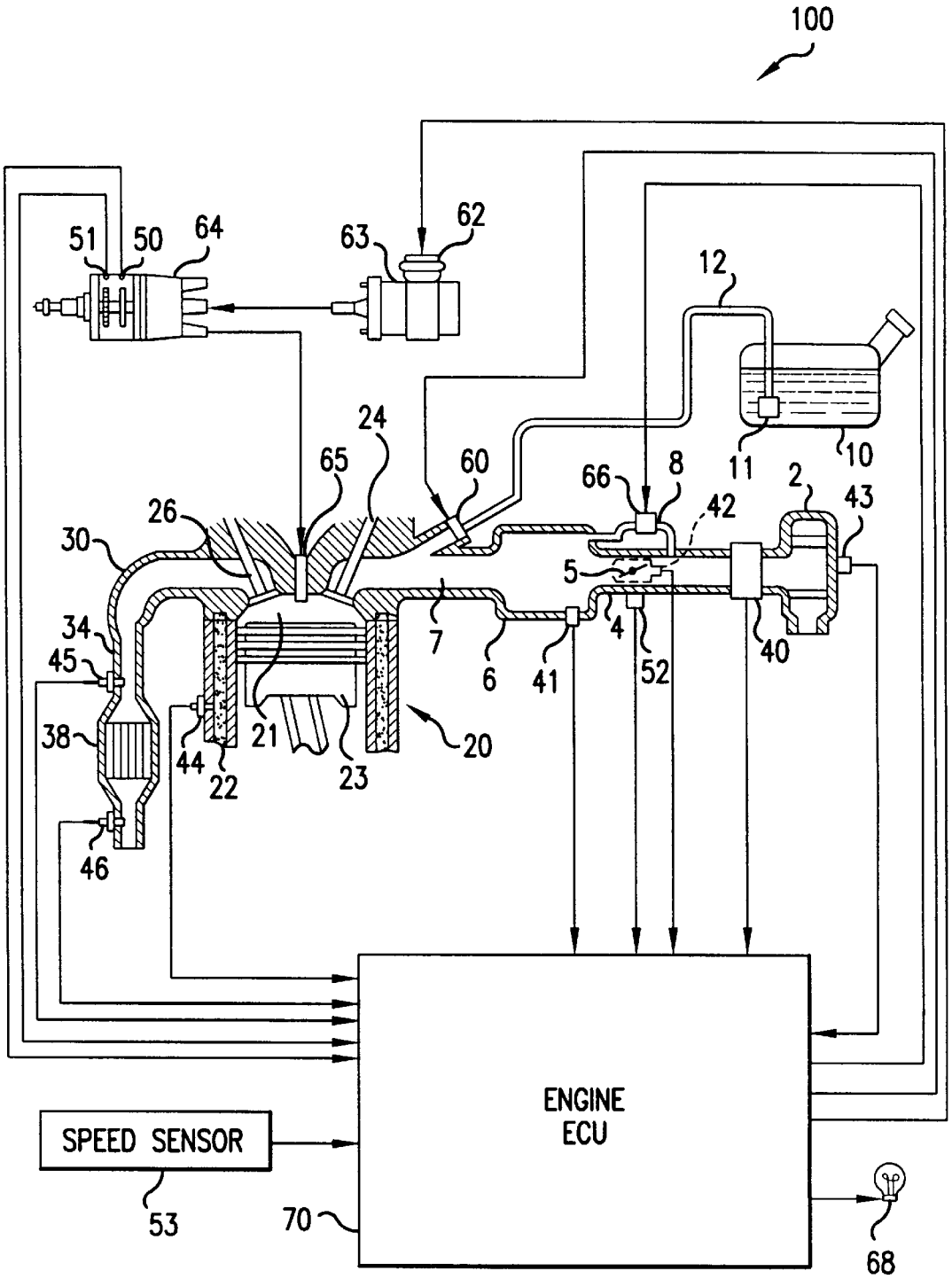
FIG. 3 is a general view showing an electronically-controlled internal combustion engine incorporating an A/F ratio sensor and an A/F ratio control device, where the A/F ratio sensor is to be tested for deterioration by the A/F ratio sensor deterioration detection device according to the present invention.

In the Examples given below, each procedure for determining the deterioration in the response characteristics of the output of an A/F ratio sensor, based on the above-described indices $S_1$, $S_2$, $S_3$, P, Q, and/or R, will be described with reference to a corresponding flow diagram The procedure in each Example is performed by the use of the CPU 71 (FIG. 4) included in the engine ECU 70 (FIG. 3). As already described with reference to FIG. 4, the system and its respective component elements as well as various sensors are coupled (via the A/D convertor circuit 75 or the input interface circuit 76) to the CPU 71, where the following procedure and determination are performed based on the signals which are provided from such elements The various data and measurement values required for the procedure are stored in the RAM 74 for use. The A/F ratio sensor OUTPUT DETERIORATION (MALFUNCTIONING) DETERMINATION routine in each Example is performed in accordance with a predetermined clock so as to be repeated at a predetermined cycle.

EXAMPLE 1

Figure 15:
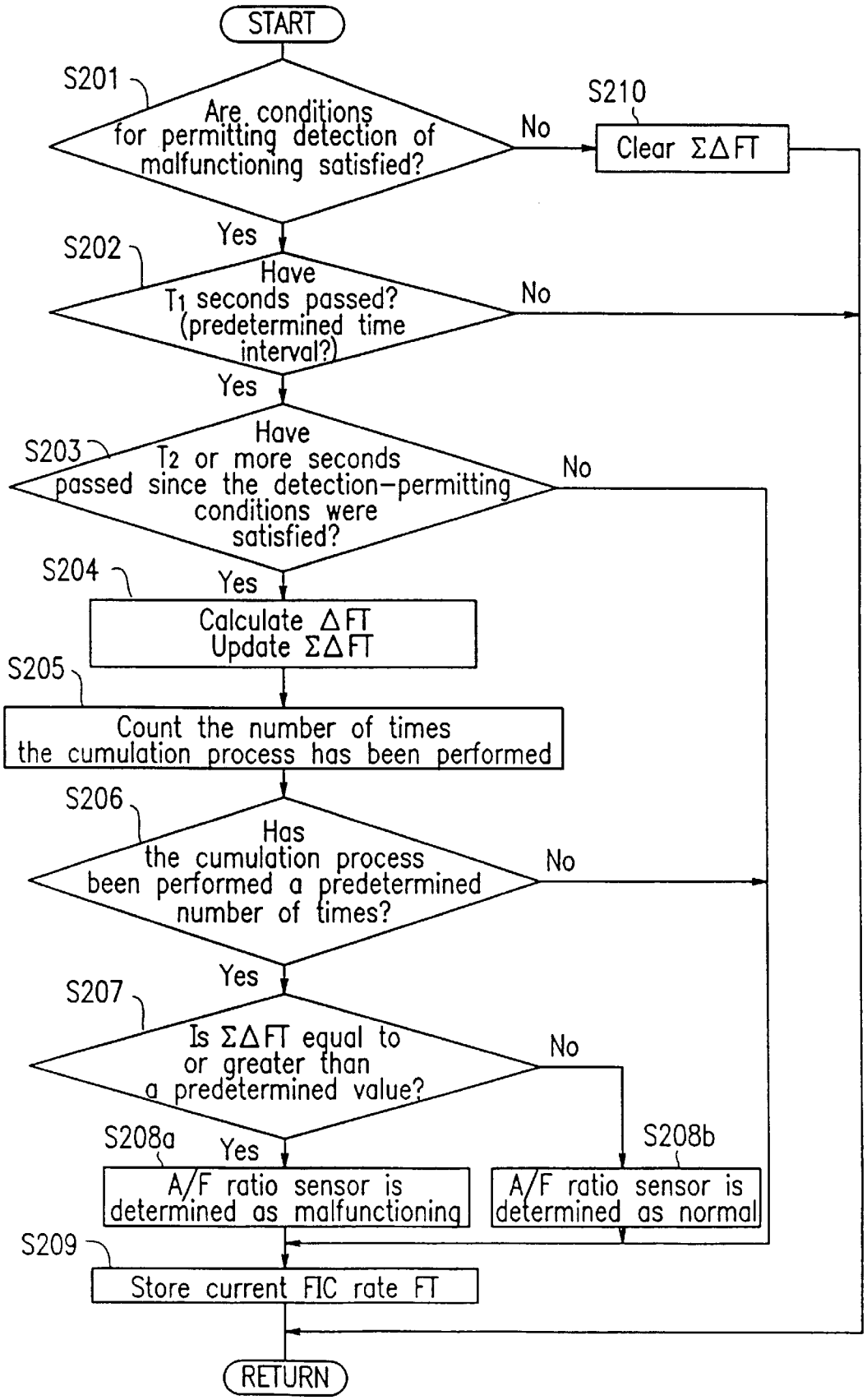
FIG. 15 is a flow diagram illustrating the A/F ratio sensor OUTPUT DETERIORATION (MALFUNCTIONING) DETERMINATION routine for determining the deterioration of an A/F ratio sensor output according to Example 1 of the present invention.

As Example 1 of the present invention, a procedure for determining the deterioration in the response characteristics of an A/F ratio sensor based on the cumulative value $S_1$ (i.e., ΣΔFT) of the variation ΔFT in the FIC rate will be described with reference to a flow diagram of FIG. 15 showing the A/F ratio sensor OUTPUT DETERIORATION (MALFUNCTIONING) DETERMINATION routine according to Example 1.

As shown in FIG. 15, at step S201, it is determined whether or not the conditions are satisfied for permitting the execution of the process for detecting the malfunctioning of the A/F ratio sensor (hereinafter such conditions are referred to as "detection-permitting conditions"). The detection-permitting conditions may include, for example, that the travel speed of the automobile is within a predetermined range; that the rotation rate of the engine is within a predetermined range; that a feedback control is ongoing; and that other components and the system are free from malfunctions which may cause misdetections. Such detection-permitting conditions are checked by detecting the input signals from various sensors. If the detection-permitting conditions are satisfied, the control proceeds to the next step S202. If the detection-permitting conditions are not satisfied, the cumulative value $S_1$ (=ΣΔFT) up to the previous call of the routine is cleared at step S210 and thereafter the control exits the routine.

The detection-permitting conditions must be satisfied in order to ensure that only accurate FIC rate values are used for the calculation of the variation ΔFT in the FIC rate at each time interval $T_1$.

The variation ΔFT in the FIC rate is calculated at every predetermined time interval $T_1$. The time interval $T_1$ is required to be sufficiently short relative to the variation cycle of A/F ratio sensor output so that an accurate cumulative value ΣΔFT of the variation ΔFT in the FIC rate is obtained. At step S202, it is determined whether or not the routine cycle (as determined by a predetermined clock) is at a point where it coincides with a cycle defined by the time interval $T_1$ for calculating the variation ΔFT in the FIC rate. If it is determined that the routine cycle does not coincide with the cycle defined by the time interval $T_1$, the control exits the routine without performing any processes. If it is determined that the routine cycle coincides with the cycle defined by the time interval $T_1$, the control proceeds to the next step S203.

The cycle of the malfunctioning detection routine must be prescribed as equal to or smaller than the time interval $T_1$ for calculating the variation ΔFT in the FIC rate. Step S202 can be omitted in the case where the cycle of the malfunctioning detection routine is prescribed as equal to the time interval $T_1$ for calculating the variation ΔFT in the FIC rate.

At step S203, it is determined whether or not $T_2$ seconds have passed since the detection-permitting conditions were confirmed to be satisfied at step S201. The reasons for performing the determination of step S203 are as follows: As described above, the detection-permitting conditions of step S201 must be satisfied in order to ensure that only accurate FIC rate values are used for the calculation of the variation ΔFT in the FIC rate at every time interval $T_1$. In order to prevent the cumulation process from being influenced by a previous state where the detection-permitting conditions were not satisfied, it is preferable to wait $T_2$ seconds after the detection-permitting conditions were satisfied before the variation ΔFT in the FIC rate is added to the cumulative value ΣΔFT (i.e., $S_1$). Thus, the accuracy of the cumulative data of the variation ΔFT in the FIC rate is ensured. Preferably, $T_1$ and $T_2$ satisfy the relationship $T_1 \leqq T_2$. If it is determined at step S203 that $T_2$ seconds have not passed after the affirmation of the detection-permitting conditions, step S209 is performed to store the current FIC rate FT, and thereafter the control exits the routine If it is determined at step S203 that $T_2$ seconds have passed after the affirmation of the detection-permitting conditions, then the control proceeds to the next step S204.

At step S204, the absolute value of a difference between the current FIC rate ($FT_m$) and the FIC rate ($FT_{m-1}$) previously stored at step S209 in a previous call of the routine (i.e., $\Delta FT_m = |FT_m - FT_{m-1}|$) is calculated, and the difference (or "variation") $\Delta FT_m$ is added to the cumulative value obtained up to the previous call of the routine (i.e., $\Sigma\Delta FT_{m-1}$), thereby updating the cumulative value ΣΔFT). When step S204 is performed for the first time after the conditions of steps S201 to S203 are satisfied, an initial value (=0) is substituted for the cumulative value ($\Sigma\Delta FT_{m-1}$) obtained up to the previous call of the routine (the initial value is used when the detection-permitting conditions are not satisfied at step S201).

Step S205 counts the number of times the cumulation process has been performed at step S204. If the cumulation process has been performed m times, it is known that the cumulation of the variation ΔFT in the FIC rate has been performed for $T_s = m \times T_1$ (defined as "hitherto-performed cumulation time") in total. Assuming that the cumulation process is to be performed a total of M times (as counted at step S206 described later), the process of cumulating the variation ΔFT in the FIC rate must be performed for a predetermined time duration of $T_\Sigma = M \times T_1$ (defined as the "cumulation time"). Alternatively, it is possible to control the predetermined time duration (cumulation time) by measuring the duration $T_{cont}$ of cumulation continued after the condition of step S203 is satisfied (i.e., $T_2$ seconds or more have passed).

The value of M representing the number of times the cumulation process is to be performed (or the cumulation time $T_\Sigma$), or the duration $T_\Sigma'$ of cumulation to be continued after the condition of step S203 is satisfied, is prescribed so that the cumulation process will be performed for a period of time sufficiently longer than the variation cycle of the FIC rate due to the feedback correction.

At step S206, it is determined whether or not the value of m (i.e., the number of times the cumulation process has been hitherto performed), as counted at step S205, is equal to or greater than the above-mentioned predetermined value M (i.e., the total number of times the cumulation process is to be performed) Alternatively, in the case where the cumulation time $T_\Sigma$ is controlled by measuring the duration $T_{cont}$ of cumulation after the condition of step S203 is satisfied, it is determined at step S206 whether or not the duration $T_{cont}$ of cumulation after the condition of step S203 is satisfied is equal to or greater than the duration $T_\Sigma'$ of cumulation to be continued after the condition of step S203 is satisfied.

It should be noted that the cumulation time $T_\Sigma$, during which the variation in the FIC rate is cumulated, need not be one continuous stretch of time. For example, if any of the detection-permitting conditions at step S201 is not satisfied before the hitherto-performed cumulation time $T_s$ reaches the predetermined value $T_\Sigma$, the cumulative value $S_1$ (i.e., ΣΔFT) of the variation ΔFT in FIC rate FT, the cumulation time $T_s$ (defined in terms of m, i.e., a number of times the cumulation process has been performed, or in terms of $T_{cont}$, i.e., a duration of cumulation after the condition of step S203 is satisfied) and the like can be stored without being cleared, so that these values can be utilized when the process is resumed after the conditions of steps S201 to S203 are again satisfied, and the cumulation process of the variation ΔFT in the FIC rate FT as well as the counting of the number m or the duration $T_{cont}$ of cumulation can be continued after the condition of step S203 is satisfied Such resumption and continuation of the process will be described later in more detail If the condition of step S206 is satisfied (i.e., if the cumulation process has been performed for the predetermined cumulation time $T_\Sigma$), then the control proceeds to step S207. If the condition of step S206 is not satisfied, only step S209 (i.e., storing the current FIC rate FT) is performed and thereafter the control exits the routine.

At step S207, it is determined whether or not the cumulative value ΣΔFT (i e., $S_1$) of the variation ΔFT in the FIC rate FT exceeds a predetermined threshold value ΣΔFT(th). If the cumulative value ΣΔFT does not exceed the threshold value ΣΔFT(th), the A/F ratio sensor is determined as having normal characteristics (step **S208*b*). If the cumulative value ΣΔFT exceeds the threshold value ΣΔFT(th), the A/F ratio sensor is determined as malfunctioning or having deteriorated characteristics (step S208*a***). When the A/F ratio sensor is determined as malfunctioning, a malfunction alert indicator within an instrument panel may be lit, for example.

EXAMPLE 2

Figure 16:
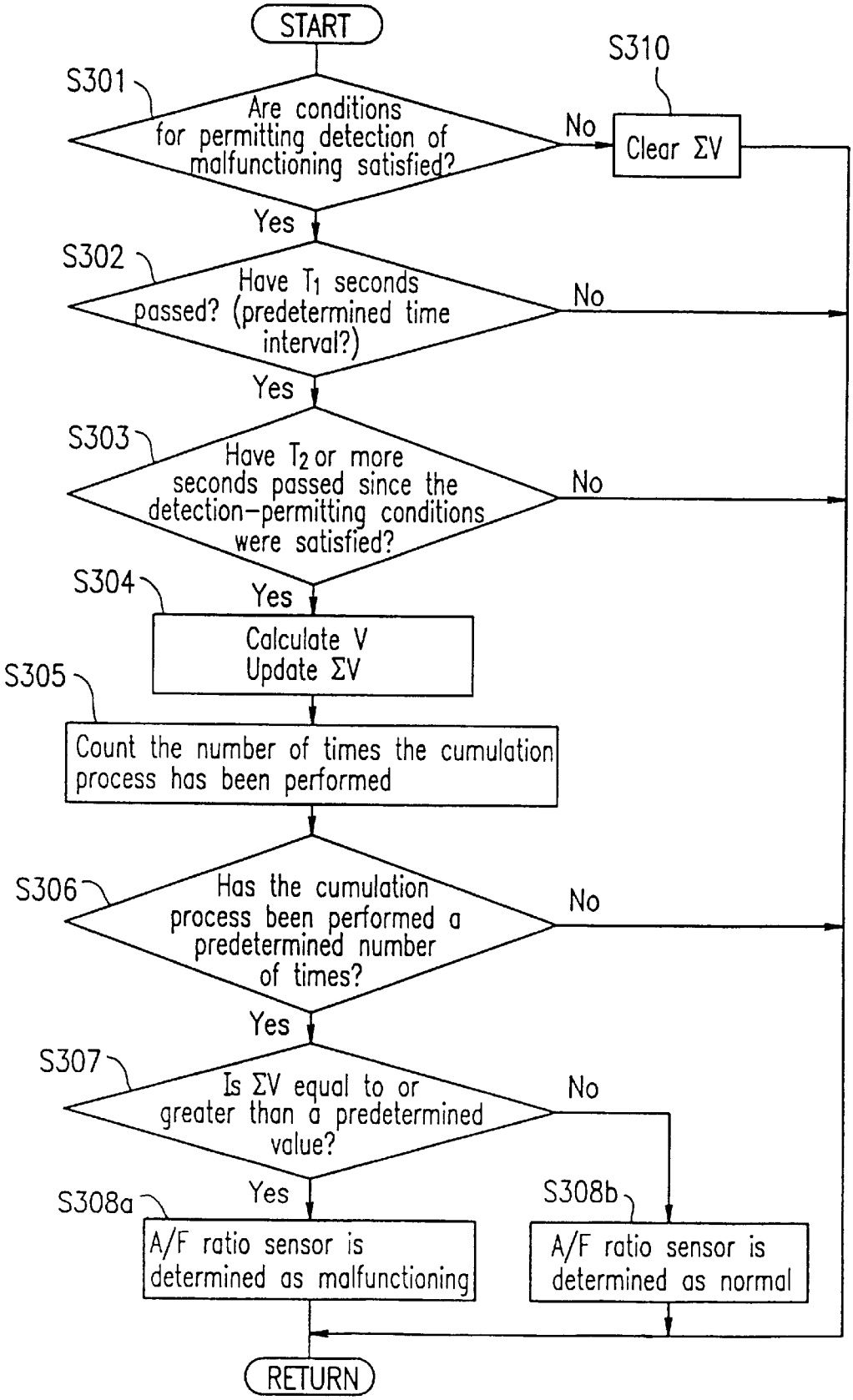
FIG. 16 is a flow diagram illustrating the A/F ratio sensor OUTPUT DETERIORATION (MALFUNCTIONING) DETERMINATION routine for determining the deterioration of an A/F ratio sensor output according to Example 2 of the present invention.

As Example 2 of the present invention, a procedure for determining the deterioration in the response characteristics of an A/F ratio sensor based on the cumulative value $S_2$ (i.e., $\Sigma V$) of the offset (i.e., the absolute value V of the A/F ratio sensor output) between the output of the A/F ratio sensor and a target output corresponding to the stoichiometric A/F ratio will be described with reference to a flow diagram of FIG. 16 showing the A/F ratio sensor OUTPUT DETERIORATION (MALFUNCTIONING) DETERMINATION routine according to Example 2.

As shown in FIG. 16, at step S301, it is determined whether or not the conditions are satisfied for permitting the execution of the process for detecting the malfunctioning of the A/F ratio sensor ("detection-permitting conditions") The detection-permitting conditions may include, for example, that the travel speed of the automobile is within a predetermined range; that the rotation rate of the engine is within a predetermined range; that a feedback control is ongoing; and that other components and the system are free from malfunctions which may cause misdetections. Such detection-permitting conditions are checked by detecting the input signals from various sensors. If the detection-permitting conditions are satisfied, the control proceeds to the next step S302. If the detection-permitting conditions are not satisfied, the cumulative value $S_1$ (=$\Sigma V$) up to the previous call of the routine is cleared at step S310 and thereafter the control exits the routine.

The detection-permitting conditions must be satisfied in order to ensure that only accurate values of the A/F ratio sensor output are used for the calculation at each time interval $T_1$.

The absolute value V of the A/F ratio sensor output is calculated at every predetermined time interval $T_1$. The time interval $T_1$ is required to be sufficiently short relative to the variation cycle of A/F ratio sensor output so that an accurate cumulative value $\Sigma V$ of the absolute value V of the A/F ratio sensor output is obtained. At step S302, it is determined whether or not the routine cycle (as determined by a predetermined clock) is at a point where it coincides with a cycle defined by the time interval $T_1$ for calculating the absolute value V of the A/F ratio sensor output If it is determined that the routine cycle does not coincide with the cycle defined by the time interval $T_1$, the control exits the routine without performing any processes. If it is determined that the routine cycle coincides with the cycle defined by the time interval $T_1$, the control proceeds to the next step S303.

The cycle of the malfunctioning detection routine must be prescribed as equal to or smaller than the time interval $T_1$ for calculating the absolute value V of the A/F ratio sensor output. Step S302 can be omitted in the case where the cycle of the malfunctioning detection routine is prescribed as equal to the time interval $T_1$ for calculating the absolute value V of the A/F ratio sensor output.

At step S303, it is determined whether or not $T_2$ seconds have passed since the detection-permitting conditions were confirmed to be satisfied at step S301. The reasons for performing the determination of step S303 are as follows: As described above, the detection-permitting conditions of step S301 must be satisfied in order to ensure that only accurate absolute values V of the A/F ratio sensor output are used for the calculation at every time interval $T_1$. In order to prevent the cumulation process from being influenced by the inaccuracy emanating from a previous state where the detection-permitting conditions were not satisfied, it is preferable to wait $T_2$ seconds after the detection-permitting conditions were satisfied before the absolute value V of the A/F ratio sensor output is added to the cumulative value $\Sigma V$ (i.e., $S_2$). Thus, the accuracy of the cumulative data of the absolute value V of the A/F ratio sensor output is ensured. Preferably, $T_1$ and $T_2$ satisfy the relationship $T_1 \leqq T_2$. If it is determined at step S303 that $T_2$ seconds have not passed after the affirmation of the detection-permitting conditions, the control exits the routine. If it is determined at step S303 that $T_2$ seconds have passed after the affirmation of the detection-permitting conditions, then the control proceeds to the next step S304.

At step S304, the absolute value V of the A/F ratio sensor output is calculated and added to the cumulative value obtained up to the previous call of the routine (i.e., $\Sigma V_{m-1}$), thereby updating the cumulative value $\Sigma V$. In the case where the A/F ratio sensor output corresponding to the stoichiometric A/F ratio is not zero, e.g., if the A/F ratio sensor output corresponding to the stoichiometric A/F ratio is designed to have a certain offset value, the offset value is eliminated before the cumulation calculation. If the control target of the A/F ratio is not the stoichiometric A/F ratio, the cumulation calculation can be directed to the cumulation of the absolute values of offsets from the target A/F ratio. When step S304 is performed for the first time after the conditions of steps S301 to S303 are satisfied, an initial value (=0) is substituted for the cumulative value ($\Sigma V_{m-1}$) obtained up to the previous call of the routine (the initial value is used when the detection-permitting conditions are not satisfied at step S301).

Step S305 counts the number of times the cumulation process has been performed at step 5304. If the cumulation process has been performed m times, it is known that the cumulation of the absolute value V of the A/F ratio sensor output has been performed for $T_s = m \times T_1$ (defined as "hitherto-performed cumulation time") in total. Assuming that the cumulation process is to be performed a total of M times (as counted at step S306 described later), the process of cumulating the absolute value V of the A/F ratio sensor output must be performed for a predetermined time duration of $T_\Sigma = M \times T_1$ (defined as the "cumulation time"). Alternatively, it is possible to control the predetermined time duration (cumulation time) by measuring the duration $T_{cont}$ of cumulation continued after the condition of step S303 is satisfied (i.e., $T_2$ seconds or more have passed).

The value of M representing the number of times the cumulation process is to be performed (or the cumulation time $T_\Sigma$), or the duration $T_\Sigma'$ of cumulation to be continued after the condition of step S303 is satisfied, is prescribed so that the cumulation process will be performed for a period of time sufficiently longer than the variation cycle of the A/F ratio sensor output due to the feedback correction.

At step S306, it is determined whether or not the value of m (i.e., the number of times the cumulation process has been hitherto performed), as counted at step S305, is equal to or greater than the above-mentioned predetermined value M (i.e., the total number of times the cumulation process is to be performed). Alternatively, in the case where the cumulation time $T_\Sigma$ is controlled by measuring the duration $T_{cont}$ of cumulation after the condition of step S303 is satisfied, it is determined at step S306 whether or not the duration $T_{cont}$ of cumulation after the condition of step S303 is satisfied is equal to or greater than the duration $T_\Sigma'$ of cumulation to be continued after the condition of step S303 is satisfied.

It should be noted that the cumulation time $T_\Sigma$, during which the absolute value V of the A/F ratio sensor output is cumulated, need not be one continuous stretch of time. For example, if any of the detection-permitting conditions at step S301 is not satisfied before the hitherto-performed cumulation time $T_s$ reaches the predetermined value $T_\Sigma$, the cumulative value $S_2$ (i.e., $\Sigma V$) of the absolute value V of the A/F ratio sensor output, the cumulation time $T_s$ (defined in terms of m, i.e., a number of times the cumulation process has been performed, or in terms of $T_{cont}$, i.e., a duration of cumulation after the condition of step S303 is satisfied) and the like can be stored without being cleared, so that these values can be utilized when the process is resumed after the conditions of steps S301 to S303 are again satisfied, and the cumulation process of the absolute value V of the A/F ratio sensor output as well as the counting of the number m or the duration $T_{cont}$ of cumulation can be continued after the condition of step S303 is satisfied. Such resumption and continuation of the process will be described later in more detail. If the condition of step S306 is satisfied (i.e., if the cumulation process has been performed for the predetermined cumulation time $T_\Sigma$), then the control proceeds to step S307. If the condition of step S306 is not satisfied, the control exits the routine.

At step S307, it is determined whether or not the cumulative value $\Sigma V$ (i.e., $S_2$) of the absolute value V of the A/F ratio sensor output exceeds a predetermined threshold value $\Sigma V(th)$. If the cumulative value $\Sigma V$ does not exceed the threshold value $\Sigma V(th)$, the A/F ratio sensor is determined as having normal characteristics (step S308*b*). If the cumulative value $\Sigma V$ exceeds the threshold value $\Sigma V(th)$, the A/F ratio sensor is determined as malfunctioning or having deteriorated characteristics (step S308*a*). When the A/F ratio sensor is determined as malfunctioning, a malfunction alert indicator within an instrument panel may be lit, for example.

In the present example, it is unnecessary to store the current A/F ratio sensor output before exiting the routine as in the other Examples because it is not necessary to calculate a difference $\Delta V$ from the A/F ratio sensor output from $T_1$ seconds ago, or a difference $\Delta FT$ from the FIC rate from $T_1$ seconds ago.

EXAMPLE 3

Figure 17:
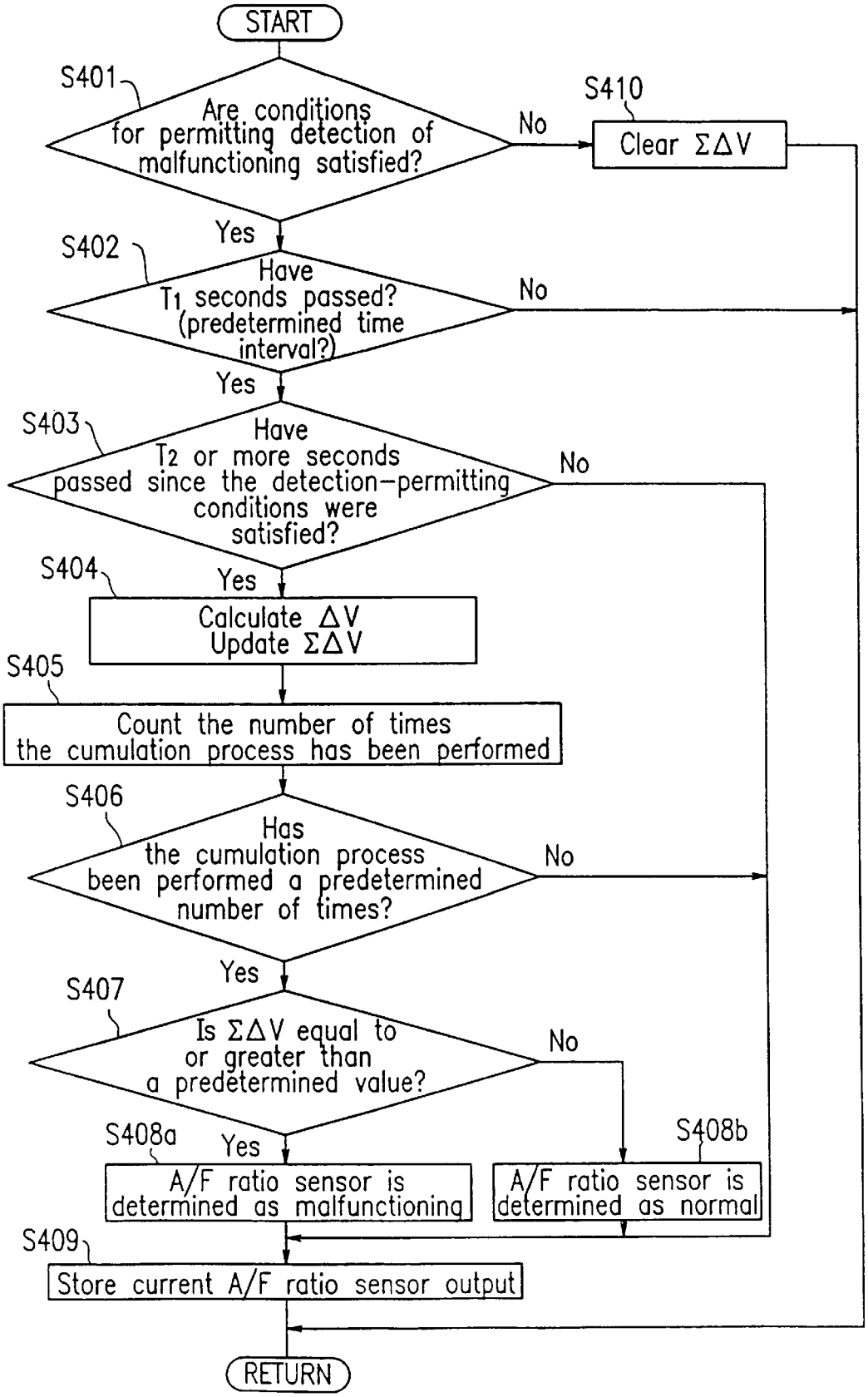
FIG. 17 is a flow diagram illustrating the A/F ratio sensor OUTPUT DETERIORATION (MALFUNCTIONING) DETERMINATION routine for determining the deterioration of an A/F ratio sensor output according to Example 3 of the present invention.

As Example 3 of the present invention, a procedure for determining the deterioration in the response characteristics of an A/F ratio sensor based on the cumulative value $S_3$ (i.e., $\Sigma\Delta V$) of the variation in the A/F ratio sensor output will be described with reference to a flow diagram of FIG. 17 showing the A/F ratio sensor OUTPUT DETERIORATION (MALFUNCTIONING) DETERMINATION routine according to Example 3.

As shown in FIG. 17, at step S401, it is determined whether or not the conditions are satisfied for permitting the execution of the process for detecting the malfunctioning of the A/F ratio sensor ("detection-permitting conditions") The detection-permitting conditions may include, for example, that the travel speed of the automobile is within a predetermined range; that the rotation rate of the engine is within a predetermined range; that a feedback control is ongoing; and that other components and the system are free from malfunctions which may cause misdetections. Such detection-permitting conditions are checked by detecting the input signals from various sensors If the detection-permitting conditions are satisfied, the control proceeds to the next step S402. If the detection-permitting conditions are not satisfied, the cumulative value $S_3$ ($=\Sigma\Delta V$) up to the previous call of the routine is cleared at step S410 and thereafter the control exits the routine.

The detection-permitting conditions must be satisfied in order to ensure that only accurate values of the variation $\Delta V$ in the A/F ratio sensor output are used for the calculation at each time interval $T_1$.

The variation $\Delta V$ in the A/F ratio sensor output is calculated at every predetermined time interval $T_1$. The time interval $T_1$ is required to be sufficiently short relative to the variation cycle of A/F ratio sensor output so that an accurate cumulative value $\Sigma\Delta V$ of the variation $\Delta V$ in the A/F ratio sensor output is obtained. At step S402, it is determined whether or not the routine cycle (i.e., as determined by a predetermined clock) is at a point where it coincides with a cycle defined by the time interval $T_1$ for calculating the variation $\Delta V$ in the A/F ratio sensor output If it is determined that the routine cycle does not coincide with the cycle defined by the time interval $T_1$, the control exits the routine without performing any processes If it is determined that the routine cycle coincides with the cycle defined by the time interval $T_1$, the control proceeds to the next step S403.

The cycle of the malfunctioning detection routine must be prescribed as equal to or smaller than the time interval $T_1$ for calculating the variation $\Delta V$ in the A/F ratio sensor output. Step S402 can be omitted in the case where the cycle of the malfunctioning detection routine is prescribed as equal to the time interval $T_1$ for calculating the variation $\Delta V$ in the A/F ratio sensor output.

At step S403, it is determined whether or not $T_2$ seconds have passed since the detection-permitting conditions were confirmed to be satisfied at step S401. The reasons for performing the determination of step S403 are as follows: As described above, the detection-permitting conditions of step S401 must be satisfied in order to ensure that only accurate values of variation $\Delta V$ in the A/F ratio sensor output are used for the calculation at every time interval $T_1$. In order to prevent the cumulation process from being influenced by a previous state where the detection-permitting conditions were not satisfied, it is preferable to wait $T_2$ seconds after the detection-permitting conditions were satisfied before the variation $\Delta V$ in the A/F ratio sensor output is added to the cumulative value $\Sigma\Delta V$ (i.e., $S_3$). Thus, the accuracy of the cumulative data of the variation $\Delta V$ in the A/F ratio sensor output is ensured. Preferably, $T_1$ and $T_2$ satisfy the relationship $T_1 \leqq T_2$. If it is determined at step S403 that $T_2$ seconds have not passed after the affirmation of the detection-permitting conditions, step S409 is performed to store the current A/F ratio sensor output and thereafter the control exits the routine. If it is determined at step S403 that $T_2$ seconds have passed after the affirmation of the detection-permitting conditions, then the control proceeds to the next step S404.

At step S404, the absolute value of a difference between the current A/F ratio sensor output ($V_m$) and the A/F ratio sensor output ($V_{m-1}$) previously stored at step S409 in a previous call of the routine (i.e., $\Delta V_m = |V_m - V_{m-1}|$) is calculated, and the difference (or "variation") $\Delta V_m$ is added to the cumulative value obtained up to the previous call of the routine (i.e., $\Sigma\Delta V_{m-1}$), thereby updating the cumulative value $\Sigma\Delta V$). When step S404 is performed for the first time after the conditions of steps S401 to S403 are satisfied, an initial value (=0) is substituted for the cumulative value ($\Sigma\Delta V_{m-1}$) obtained up to the previous call of the routine (the initial value is used when the detection-permitting conditions are not satisfied at step S401).

Step S405 counts the number of times the cumulation process has been performed at step S404. If the cumulation process has been performed m times, it is known that the cumulation of the variation $\Delta V$ in the A/F ratio sensor output has been performed for $T_s = m \times T_1$ (defined as "hitherto-performed cumulation time") in total. Assuming that the cumulation process is to be performed a total of M times (as counted at step S406 described later), the process of cumulating the variation ΔV in the A/F ratio sensor output must be performed for a predetermined time duration of $T_\Sigma = M \times T_1$ (defined as the "cumulation time"). Alternatively, it is possible to control the predetermined time duration (cumulation time) by measuring the duration $T_{cont}$ of cumulation continued after the condition of step S403 is satisfied (i.e., $T_2$ seconds or more have passed).

The value of M representing the number of times the cumulation process is to be performed (or the cumulation time $T_\Sigma$), or the duration $T_\Sigma'$ of cumulation to be continued after the condition of step S403 is satisfied, is prescribed so that the cumulation process will be performed for a period of time sufficiently longer than the variation cycle of the variation ΔV in the A/F ratio sensor output due to the feedback correction.

At step S406, it is determined whether or not the value of m (i.e., the number of times the cumulation process has been hitherto performed), as counted at step S405, is equal to or greater than the above-mentioned predetermined value M (i.e., the total number of times the cumulation process is to be performed). Alternatively, in the case where the cumulation time $T_\Sigma$ is controlled by measuring the duration $T_{cont}$ of cumulation after the condition of step S403 is satisfied, it is determined at step S406 whether or not the duration $T_{cont}$ of cumulation after the condition of step S403 is satisfied is equal to or greater than the duration $T_\Sigma'$ of cumulation to be continued after the condition of step S403 is satisfied.

It should be noted that the cumulation time $T_\Sigma$, during which the variation ΔV in the A/F ratio sensor output is cumulated, need not be one continuous stretch of time. For example, if any of the detection-permitting conditions at step S401 is not satisfied before the hitherto-performed cumulation time $T_s$ reaches the predetermined value $T_\Sigma$, the cumulative value $S_3$ (i.e., ΣΔV) of the variation ΔV in the A/F ratio sensor output, the cumulation time $T_s$ (defined in terms of m, i.e., a number of times the cumulation process has been performed, or in terms of $T_{cont}$, i.e., a duration of cumulation after the condition of step S403 is satisfied) and the like can be stored without being cleared, so that these values can be utilized when the process is resumed after the conditions of steps S401 to S403 are again satisfied, and the cumulation process of the variation ΔV in the A/F ratio sensor output as well as the counting of the number m or the duration $T_{cont}$ of cumulation can be continued after the condition of step S403 is satisfied. Such resumption and continuation of the process will be described later in more detail If the condition of step S406 is satisfied (i.e., if the cumulation process has been performed for the predetermined cumulation time $T_\Sigma$), then the control proceeds to step S407. If the condition of step S406 is not satisfied, only step S409 (i.e., storing the current A/F ratio sensor output) is performed and thereafter the control exits the routine.

At step S407, it is determined whether or not the cumulative value ΣΔV (i.e., $S_3$) of the variation ΔV in the A/F ratio sensor output exceeds a predetermined threshold value ΣΔV(th). If the cumulative value ΣΔV does not exceed the threshold value ΣΔV(th), the A/F ratio sensor is determined as having normal characteristics (step S408*b*). If the cumulative value ΣΔV exceeds the threshold value ΣΔV(th), the A/F ratio sensor is determined as malfunctioning or having deteriorated characteristics (step S408*a*). When the A/F ratio sensor is determined as malfunctioning, a malfunction alert indicator within an instrument panel may be lit, for example.

EXAMPLE 4

As Example 4 of the present invention, a procedure for determining the deterioration in the response characteristics of an A/F ratio sensor based on the cumulative value $S_1$ (i.e., ΣΔFT) of the variation ΔFT in the FIC rate and the cumulative value $S_3$ (i.e., ΣΔV) of the variation ΔV in the A/F ratio sensor output will be described with reference to a flow diagram of FIG. 18 showing the A/F ratio sensor OUTPUT DETERIORATION (MALFUNCTIONING) DETERMINATION routine according to Example 4.

As shown in FIG. 18, at step S501, it is determined whether or not the conditions are satisfied for permitting the execution of the process for detecting the malfunctioning of the A/F ratio sensor ("detection-permitting conditions"). The detection-permitting conditions may include, for example, that the travel speed of the automobile is within a predetermined range; that the rotation rate of the engine is within a predetermined range; that a feedback control is ongoing; and that other components and the system are free from malfunctions which may cause misdetections. Such detection-permitting conditions are checked by detecting the input signals from various sensors If the detection-permitting conditions are satisfied, the control proceeds to the next step S502. If the detection-permitting conditions are not satisfied, the cumulative value $S_1$ (=ΣΔFT) and $S_3$ (=ΣΔV) up to the previous call of the routine is cleared at step S513 and thereafter the control exits the routine.

The detection-permitting conditions must be satisfied in order to ensure that only accurate FIC rate values and accurate A/F ratio sensor output values are used for the calculation at each time interval $T_1$.

The variation ΔFT in the FIC rate and the variation ΔV in the A/F ratio sensor output are calculated at every predetermined time interval $T_1$. The time interval $T_1$ is required to be sufficiently short relative to the variation cycle of A/F ratio sensor output so that an accurate cumulative value ΣΔFT of the variation ΔFT in the FIC rate and an accurate cumulative value ΣΔFT of the variation ΔV in the A/F ratio sensor output are obtained. At step S502, it is determined whether or not the routine cycle (i.e., as determined by a predetermined clock) is at a point where it coincides with a cycle defined by the time interval $T_1$ for calculating the variation ΔFT in the FIC rate and the variation ΔV in the A/F ratio sensor output. If it is determined that the routine cycle does not coincide with the cycle defined by the time interval $T_1$, the control exits the routine without performing any processes. If it is determined that the routine cycle coincides with the cycle defined by the time interval $T_1$, the control proceeds to the next step S503.

The cycle of the malfunctioning detection routine must be prescribed as equal to or smaller than the time interval $T_1$ for calculating the variation ΔFT in the FIC rate and the variation ΔV in the A/F ratio sensor output Step S502 can be omitted in the case where the cycle of the malfunctioning detection routine is prescribed as equal to the time interval $T_1$ for calculating the variation ΔFT in the FIC rate and the variation ΔV in the A/F ratio sensor output.

At step S503, it is determined whether or not $T_2$ seconds have passed since the detection-permitting conditions were confirmed to be satisfied at step S501. The reasons for performing the determination of step S503 are as follows: As described above, the detection-permitting conditions of step S501 must be satisfied in order to ensure that only accurate FIC rate values and accurate values of A/F ratio sensor output are used for the respective calculation of the variation ΔFT in the FIC rate and the variation ΔV in the A/F ratio sensor output at every time interval $T_1$. In order to prevent the cumulation process from being influenced by a previous state where the detection-permitting conditions were not satisfied, it is preferable to wait $T_2$ seconds after the detection-permitting conditions were satisfied before the variation ΔFT in the FIC rate is added to the cumulative value ΣΔFT (i.e., $S_1$) and the variation ΔV in the A/F ratio sensor output is added to the cumulative value ΣΔV (i.e. $S_3$). Thus, the accuracy of the cumulative data of the variation ΔFT in the FIC rate and the cumulative data of the variation ΔV in the A/F ratio sensor output is ensured. Preferably, $T_1$ and $T_2$ satisfy the relationship $T_1 \leqq T_2$. If it is determined at step S503 that $T_2$ seconds have not passed after the affirmation of the detection-permitting conditions, step S511 is performed to store the current FIC rate FT and step S512 is performed to store the current A/F ratio sensor output, and thereafter the control exits the routine. If it is determined at step S503 that $T_2$ seconds have passed after the affirmation of the detection-permitting conditions, then the control proceeds to the next step S504.

At step S504, the absolute value of a difference between the current FIC rate ($FT_m$) and the FIC rate ($FT_{m-1}$) previously stored at step S511 in a previous call of the routine (i.e., $\Delta FT_m=|FT_m-FT_{m-1}|$) is calculated, and the difference (or "variation") $\Delta FT_m$ is added to the cumulative value obtained up to the previous call of the routine (i.e., $\Sigma\Delta FT_{m-1}$), thereby updating the cumulative value ΣΔFT). When step S504 is performed for the first time after the conditions of steps S501 to S503 are satisfied, an initial value (=0) is substituted for the cumulative value ($\Sigma\Delta FT_{m-1}$) obtained up to the previous call of the routine (the initial value is used when the detection-permitting conditions are not satisfied at step S501).

At step S505, the absolute value of a difference between the A/F ratio sensor output ($V_m$) and the A/F ratio sensor output ($V_{m-1}$) previously stored at step S512 in a previous call of the routine (i.e., $\Delta V_m=|V_m-V_{m-1}|$) is calculated, and the difference (or "variation") $\Delta V_m$ is added to the cumulative value obtained up to the previous call of the routine (i.e., $\Sigma\Delta V_{m-1}$), thereby updating the cumulative value ΣΔV). When step S505 is performed for the first time after the conditions of steps S501 to S503 are satisfied, an initial value (=0) is substituted for the cumulative value ($\Sigma\Delta V_{m-1}$) obtained up to the previous call of the routine (the initial value is used when the detection-permitting conditions are not satisfied at step S501).

Step S506 counts the number of times the cumulation process has been performed at step S504 and at step S505. If the cumulation process has been performed m times, it is known that the cumulation of the variation ΔFT in the FIC rate and the variation ΔV in the A/F ratio sensor output has been performed for $T_s=m\times T_1$ (defined as "hitherto-performed cumulation time") in total. Assuming that the cumulation process is to be performed a total of M times (as counted at step S506 described later), the process of cumulating the variation ΔFT in the FIC rate and the variation ΔV in the A/F ratio sensor output must be performed for a predetermined time duration of $T_\Sigma=M\times T_1$ (defined as the "cumulation time"). Alternatively, it is possible to control the predetermined time duration (cumulation time) by measuring the duration $T_{cont}$ of cumulation continued after the condition of step S503 is satisfied (i.e., $T_2$ seconds or more have passed).

The value of M representing the number of times the cumulation process is to be performed (or the cumulation time $T_\Sigma$), or the duration $T_\Sigma'$ of cumulation to be continued after the condition of step S503 is satisfied, is prescribed so that the cumulation process will be performed for a period of time sufficiently longer than the variation cycle of the FIC rate and the variation cycle of the A/F ratio sensor output due to the feedback correction.

At step S507, it is determined whether or not the value of m (i.e., the number of times the cumulation process has been hitherto performed), as counted at step S506, is equal to or greater than the above-mentioned predetermined value M (i.e., the total number of times the cumulation process is to be performed). Alternatively, in the case where the cumulation time $T_\Sigma$ is controlled by measuring the duration $T_{cont}$ of cumulation after the condition of step S503 is satisfied, it is determined at step S507 whether or not the duration $T_{cont}$ of cumulation after the condition of step S503 is satisfied is equal to or greater than the duration $T_\Sigma'$ of cumulation to be continued after the condition of step S503 is satisfied.

It should be noted that the cumulation time $T_\Sigma$, during which the variation in the FIC rate and the variation ΔV in the A/F ratio sensor output are cumulated, need not be one continuous stretch of time. For example, if any of the detection-permitting conditions at step S501 is not satisfied before the hitherto-performed cumulation time $T_s$ reaches the predetermined value $T_\Sigma$, the cumulative value $S_1$ (i.e., ΣΔFT) of the variation ΔFT in the FIC rate FT, the cumulative value $S_3$ (i.e., ΣΔV) of variation ΔV in the A/F ratio sensor output, the cumulation time $T_s$ (defined in terms of m, i.e., a number of times the cumulation process has been performed, or in terms of $T_{cont}$, i.e., a duration of cumulation after the condition of step S503 is satisfied) and the like can be stored without being cleared, so that these values can be utilized when the process is resumed after the conditions of steps S501 to S503 are again satisfied, and the cumulation process of the variation ΔFT in the FIC rate FT and the variation ΔV in the A/F ratio sensor output as well as the counting of the number m or the duration $T_{cont}$ of cumulation can be continued after the condition of step S503 is satisfied. Such resumption and continuation of the process will be described later in more detail. If the condition of step S507 is satisfied (i.e., if the cumulation process has been performed for the predetermined cumulation time $T_\Sigma$), then the control proceeds to step S508. If the condition of step S507 is not satisfied, step S511 (i.e., storing the current FIC rate FT) and step S512 (i.e., storing the current A/F ratio sensor output) are performed and thereafter the control exits the routine.

At step S508, a ratio P of the cumulative value ΣΔFT of the variation ΔFT in the FIC rate and the cumulative value ΣΔV of the variation ΔV in the A/F ratio sensor output (i.e., P=ΣΔFT/ΣΔV) is calculated.

At step S509, it is determined whether or not the ratio P=ΣΔFT/ΣΔV calculated at step S508 exceeds a predetermined threshold value P(th). If the ratio P does not exceed the threshold value P(th), the A/F ratio sensor is determined as having normal characteristics (step **S510*b*). If the ratio P exceeds the threshold value P(th), the A/F ratio sensor is determined as malfunctioning or having deteriorated characteristics (step S510*a***). When the A/F ratio sensor is determined as malfunctioning, a malfunction alert indicator within an instrument panel may be lit, for example.

The comparison between the ratio P=ΣΔFT/ΣΔV against the threshold value P(th) can also be made as follows, for example: A reference ratio $P_0$, defined as a ratio ΣΔFT/ΣΔV of an A/F ratio sensor known to have normal response characteristics, is previously calculated. Then, it can be determined whether or not the ratio of the above-mentioned ratio P to the reference ratio $P_0$ exceeds the threshold value P(th).

EXAMPLE 5

Figure 19:
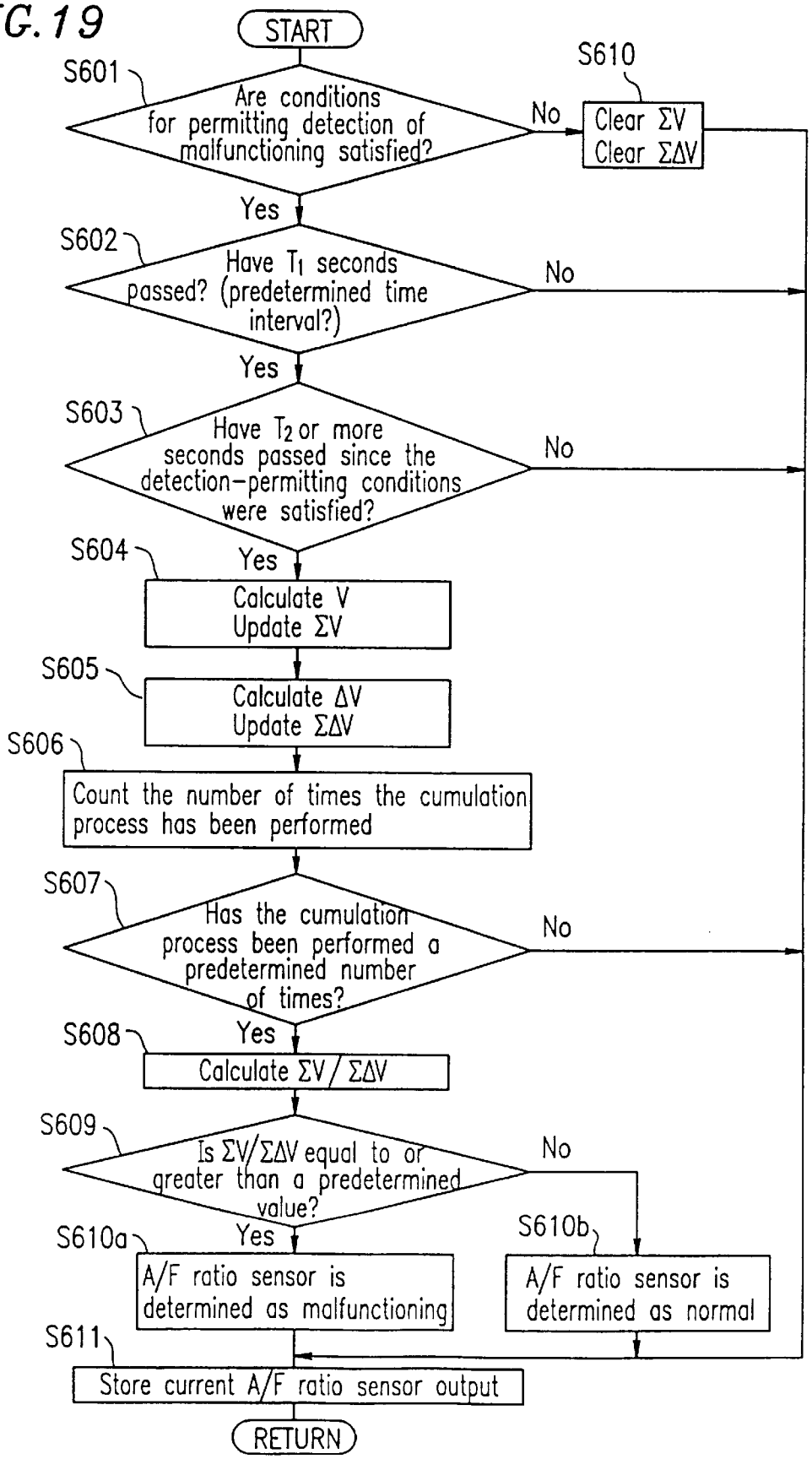
FIG. 19 is a flow diagram illustrating the A/F ratio sensor OUTPUT DETERIORATION (MALFUNCTIONING) DETERMINATION routine for determining the deterioration of an A/F ratio sensor output according to Example 5 of the present invention.

As Example 5 of the present invention, a procedure for determining the deterioration in the response characteristics of an A/F ratio sensor based on the cumulative value $S_2$ (i.e., $\Sigma V$) of the absolute values of the A/F ratio sensor output and the cumulative value $S_3$ (i.e., $\Sigma\Delta V$) of the variation $\Delta V$ in the A/F ratio sensor output will be described with reference to a flow diagram of FIG. 19 showing the A/F ratio sensor OUTPUT DETERIORATION (MALFUNCTIONING) DETERMINATION routine according to Example 5.

As shown in FIG. 19, at step S601, it is determined whether or not the conditions are satisfied for permitting the execution of the process for detecting the malfunctioning of the A/F ratio sensor ("detection-permitting conditions") The detection-permitting conditions may include, for example, that the travel speed of the automobile is within a predetermined range; that the rotation rate of the engine is within a predetermined range; that a feedback control is ongoing; and that other components and the system are free from malfunctions which may cause misdetections. Such detection-permitting conditions are checked by detecting the input signals from various sensors. If the detection-permitting conditions are satisfied, the control proceeds to the next step S602. If the detection-permitting conditions are not satisfied, the cumulative value $S_2$ ($=\Sigma V$) and $S_3$ ($=\Sigma\Delta V$) up to the previous call of the routine are cleared at step S612 and thereafter the control exits the routine.

The detection-permitting conditions must be satisfied in order to ensure that only accurate A/F ratio sensor output values and accurate values of variation therein are used for the calculation at each time interval $T_1$.

The absolute value V of the A/F ratio sensor output and the variation $\Delta V$ in the A/F ratio sensor output are calculated at every predetermined time interval $T_1$. The time interval $T_1$ is required to be sufficiently short relative to the variation cycle of A/F ratio sensor output so that an accurate cumulative value $\Sigma V$ of the absolute value V of the A/F ratio sensor output and an accurate cumulative value $\Sigma\Delta V$ of the variation $\Delta V$ in the A/F ratio sensor output are obtained At step S602, it is determined whether or not the routine cycle (i.e., as determined by a predetermined clock) is at a point where it coincides with a cycle defined by the time interval $T_1$ for calculating the absolute value V of the A/F ratio sensor output and the variation $\Delta V$ in the A/F ratio sensor output. If it is determined that the routine cycle does not coincide with the cycle defined by the time interval $T_1$, the control exits the routine without performing any processes. If it is determined that the routine cycle coincides with the cycle defined by the time interval $T_1$, the control proceeds to the next step S603.

The cycle of the malfunctioning detection routine must be prescribed as equal to or smaller than the time interval $T_1$ for calculating the absolute value V of the A/F ratio sensor output and the variation $\Delta V$ in the A/F ratio sensor output. Step S602 can be omitted in the case where the cycle of the malfunctioning detection routine is prescribed as equal to the time interval $T_1$ for calculating the absolute value V of the A/F ratio sensor output and the variation $\Delta V$ in the A/F ratio sensor output.

At step S603, it is determined whether or not $T_2$ seconds have passed since the detection-permitting conditions were confirmed to be satisfied at step S601. The reasons for performing the determination of step S603 are as follows: As described above, the detection-permitting conditions of step S601 must be satisfied in order to ensure that only accurate A/F ratio sensor output values V and accurate values of variation $\Delta V$ therein are used for the calculation at each time interval $T_1$. In order to prevent the cumulation process from being influenced by a previous state where the detection-permitting conditions were not satisfied, it is preferable to wait $T_2$ seconds after the detection-permitting conditions were satisfied before the absolute value V of the A/F ratio sensor output is added to the cumulative value $\Sigma V$ (i.e., $S_2$) and the variation $\Delta V$ in the A/F ratio sensor output is added to the cumulative value $\Sigma\Delta V$ (i.e., $S_3$) and the variation $\Delta V$ in the A/F ratio sensor output is added to the cumulative value $\Sigma\Delta V$ (i.e. $S_3$). Thus, the accuracy of the cumulative data of the A/F ratio sensor output values V and the cumulative data of the variation $\Delta V$ in the A/F ratio sensor output is ensured. Preferably, $T_1$ and $T_2$ satisfy the relationship $T_1 \leqq T_2$. If it is determined at step S603 that $T_2$ seconds have not passed after the affirmation of the detection-permitting conditions, step S609 is performed to store the current FIC rate FT and step S611 is performed to store the current. A/F ratio sensor output, and thereafter the control exits the routine. If it is determined at step S603 that $T_2$ seconds have passed after the affirmation of the detection-permitting conditions, then the control proceeds to the next step S604.

At step S604, the absolute value V of the A/F ratio sensor output is calculated and added to the cumulative value obtained up to the previous call of the routine (i.e., $\Sigma V_{m-1}$), thereby updating the cumulative value $\Sigma V$. In the case where the A/F ratio sensor output corresponding to the stoichiometric A/F ratio is not zero, e.g., if the A/F ratio sensor output corresponding to the stoichiometric A/F ratio is designed to have a certain offset value, the offset value is eliminated before the cumulation calculation. If the control target of the A/F ratio is not the stoichiometric A/F ratio, the cumulation calculation can be directed to the cumulation of the absolute values of offsets from the target A/F ratio. When step S604 is performed for the first time after the conditions of steps S601 to S603 are satisfied, an initial value (=0) is substituted for the cumulative value ($\Sigma V_{m-1}$) obtained up to the previous call of the routine (the initial value is used when the detection-permitting conditions are not satisfied at step S601).

At step S605, the absolute value of a difference between the A/F ratio sensor output ($V_m$) and the A/F ratio sensor output ($V_{m-1}$) previously stored at step S611 in a previous call of the routine (i.e., $\Delta V_m = |V_m - V_{m-1}|$) is calculated, and the difference (or "variation") $\Delta V_m$ is added to the cumulative value obtained up to the previous call of the routine (i.e., $\Sigma\Delta V_{m-1}$), thereby updating the cumulative value $\Sigma\Delta V$). When step S605 is performed for the first time after the conditions of steps S601 to S603 are satisfied, an initial value (=0) is substituted for the cumulative value ($\Sigma\Delta V_{m-1}$) obtained up to the previous call of the routine (the initial value is used when the detection-permitting conditions are not satisfied at step S601).

Step S606 counts the number of times the cumulation process has been performed at step S604 and at step S605. If the cumulation process has been performed m times, it is known that the cumulation of the absolute value V of the A/F ratio sensor output and the variation $\Delta V$ in the A/F ratio sensor output has been performed for $T_s = m \times T_1$ (defined as "hitherto-performed cumulation time") in total. Assuming that the cumulation process is to be performed a total of M times (as counted at step S606 described later), the process of cumulating the absolute value V of the A/F ration sensor output and the variation $\Delta V$ in the A/F ratio sensor output must be performed for a predetermined time duration of $T_\Sigma = M \times T_1$ (defined as the "cumulation time"). Alternatively, it is possible to control the predetermined time duration (cumulation time) by measuring the duration $T_{cont}$ of cumulation continued after the condition of step S603 is satisfied (i.e., $T_2$ seconds or more have passed).

The value of M representing the number of times the cumulation process is to be performed (or the cumulation time $T_\Sigma$), or the duration $T_\Sigma'$ of cumulation to be continued after the condition of step S603 is satisfied, is prescribed so that the cumulation process will be performed for a period of time sufficiently longer than the variation cycle of the A/F ratio sensor output due to the feedback correction.

At step S607, it is determined whether or not the value of m (i.e., the number of times the cumulation process has been hitherto performed), as counted at step S606 , is equal to or greater than the above-mentioned predetermined value M (i.e., the total number of times the cumulation process is to be performed).

Alternatively, in the case where the cumulation time $T_\Sigma$ is controlled by measuring the duration $T_{cont}$ of cumulation after the condition of step S603 is satisfied, it is determined at step S607 whether or not the duration $T_{cont}$ of cumulation after the condition of step S603 is satisfied is equal to or greater than the duration $T_\Sigma'$ of cumulation to be continued after the condition of step S603 is satisfied.

It should be noted that the cumulation time $T_\Sigma$, during which the absolute value V of the A/F ratio sensor output and the variation ΔV in the A/F ratio sensor output are cumulated, need not be one continuous stretch of time. For example, if any of the detection-permitting conditions at step S601 is not satisfied before the hitherto-performed cumulation time $T_s$ reaches the predetermined value $T_\Sigma$, the cumulative value $S_2$ (i.e., ΣV) of the absolute value V of the A/F ratio sensor output, the cumulative value $S_3$ (i.e., ΣΔV) of variation ΔV in the A/F ratio sensor output, the cumulation time $T_s$ (defined in terms of m, i.e., a number of times the cumulation process has been performed, or in terms of $T_{cont}$, i.e., a duration of cumulation after the condition of step S603 is satisfied) and the like can be stored without being cleared, so that these values can be utilized when the process is resumed after the conditions of steps S601 to S603 are again satisfied, and the cumulation process of the absolute value V of the A/F ratio sensor output and the variation ΔV in the A/F ratio sensor output as well as the counting of the number m or the duration $T_{cont}$ of cumulation can be continued after the condition of step S603 is satisfied. Such resumption and continuation of the process will be described later in more detail. If the condition of step S607 is satisfied (i.e., if the cumulation process has been performed for the predetermined cumulation time $T_\Sigma$), then the control proceeds to step S608. If the condition of step S607 is not satisfied, only step S611 (i.e., storing the current A/F ratio sensor output) is performed and thereafter the control exits the routine.

At step S608, a ratio Q of the cumulative value ΣV of the absolute values of the A/F ratio sensor output and the cumulative value ΣΔV of the variation in the A/F ratio sensor output (i.e., Q=ΣV/ΣΔV) is calculated.

At step S609, it is determined whether or not the ratio Q=ΣV/ΣΔV calculated at step S608 exceeds a predetermined threshold value Q(th). If the ratio Q does not exceed the threshold value Q(th), the A/F ratio sensor is determined as having normal characteristics (step S610*b*). If the ratio Q exceeds the threshold value Q(th), the A/F ratio sensor is determined as malfunctioning or having deteriorated characteristics (step S610*a*). When the A/F ratio sensor is determined as malfunctioning, a malfunction alert indicator within an instrument panel may be lit, for example.

The comparison between the ratio Q=ΣV/ΣΔV against the threshold value Q(th) can also be made as follows, for example: A reference ratio $Q_0$, defined as a ratio ΣV/ΣΔV of an A/F ratio sensor known to have normal response characteristics, is previously calculated. Then, it can be determined whether or not the ratio of the above-mentioned ratio Q to the reference ratio $Q_0$ exceeds the threshold value Q(th).

EXAMPLE 6

Figure 20:
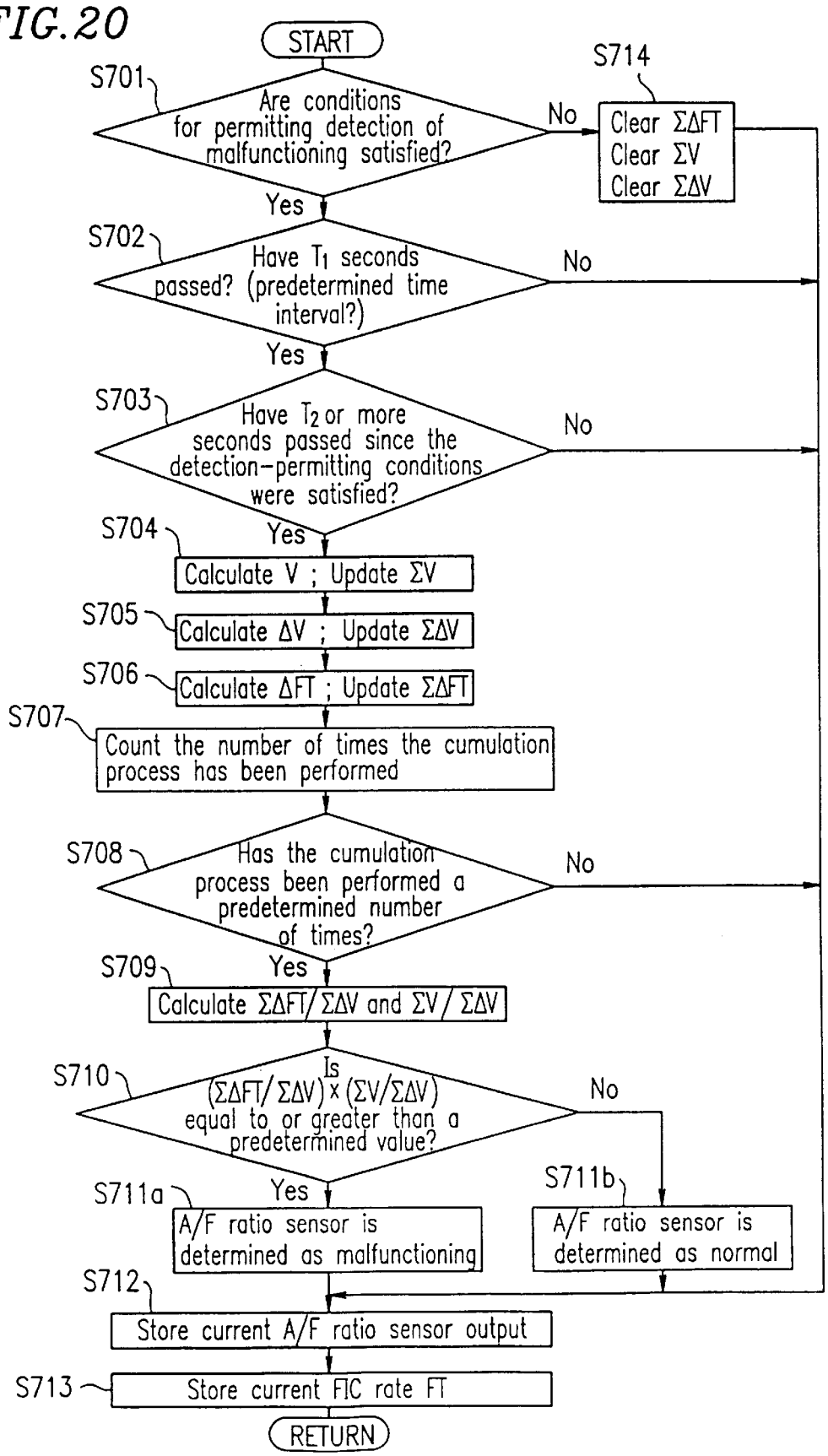
FIG. 20 is a flow diagram illustrating the A/F ratio sensor OUTPUT DETERIORATION (MALFUNCTIONING) DETERMINATION routine for determining the deterioration of an A/F ratio sensor output according to Example 6 of the present invention.

As Example 6 of the present invention, a procedure for determining the deterioration in the response characteristics of an A/F ratio sensor based on the cumulative value $S_1$ (i.e., ΣΔFT) of the variation ΔFT in the FIC rate, the cumulative value $S_2$ (i.e., ΣV) of the absolute values of the A/F ratio sensor output and the cumulative value $S_3$ (i.e., ΣΔV) of the variation ΔV in the A/F ratio sensor output will be described with reference to a flow diagram of FIG. 20 showing the A/F ratio sensor OUTPUT DETERIORATION (MALFUNCTIONING) DETERMINATION routine according to Example 6.

As shown in FIG. 20, at step S701, it is determined whether or not the conditions are satisfied for permitting the execution of the process for detecting the malfunctioning of the A/F ratio sensor ("detection-permitting conditions"). The detection-permitting conditions may include, for example, that the travel speed of the automobile is within a predetermined range; that the rotation rate of the engine is within a predetermined range; that a feedback control is ongoing; and that other components and the system are free from malfunctions which may cause misdetections. Such detection-permitting conditions are checked by detecting the input signals from various sensors. If the detection-permitting conditions are satisfied, the control proceeds to the next step S702. If the detection-permitting conditions are not satisfied, the cumulative value $S_1$ (=ΣΔFT), the cumulative value $S_2$ (=ΣV) and the cumulative value $S_3$ (=ΣΔV) up to the previous call of the routine are cleared at step S714 and thereafter the control exits the routine.

The detection-permitting conditions must be satisfied in order to ensure that only accurate A/F ratio sensor output values and accurate values of variation therein are used for the calculation at each time interval $T_1$.

The, the variation ΔFT in the FIC rate, the absolute value V of the A/F ratio sensor output and the variation ΔV in the A/F ratio sensor output are calculated at every predetermined time interval $T_1$. The time interval $T_1$ is required to be sufficiently short relative to the variation cycle of A/F ratio sensor output so that an accurate cumulative value ΣΔFT of the variation ΔFT in the FIC rate, an accurate cumulative value ΣV of the absolute value V of the A/F ratio sensor output, and an accurate cumulative value ΣΔV of the variation ΔV in the A/F ration sensor output are obtained. At step S702, it is determined whether or not the routine cycle (i.e., as determined by a predetermined clock) is at a point where it coincides with a cycle defined by the time interval $T_1$ for calculating the variation ΔFT in the FIC rate, the absolute value V of the A/F ratio sensor output, and the variation ΔV in the A/F ratio sensor output. If it is determined that the routine cycle does not coincide with the cycle defined by the time interval $T_1$, the control exits the routine without performing any processes. If it is determined that the routine cycle coincides with the cycle defined by the time interval $T_1$, the control proceeds to the next step S703.

The cycle of the malfunctioning detection routine must be prescribed as equal to or smaller than the time interval $T_1$ for calculating the variation ΔFT in the FIC rate, the absolute value V of the A/F ratio sensor output, and the variation ΔV in the A/F ratio sensor output Step S702 can be omitted in the case where the cycle of the malfunctioning detection routine is prescribed as equal to the time interval $T_1$ for calculating the variation ΔFT in the FIC rate, the absolute value V of the A/F ratio sensor output, and the variation ΔV in the A/F ratio sensor output.

At step S703, it is determined whether or not $T_2$ seconds have passed since the detection-permitting conditions were confirmed to be satisfied at step S701. The reasons for performing the determination of step S703 are as follows: As described above, the detection-permitting conditions of step S701 must be satisfied in order to ensure that only accurate values of variation ΔFT in the FIC rate, accurate A/F ratio sensor output values V, and accurate values of variation ΔV therein are used for the calculation at each time interval $T_1$. In order to prevent the cumulation process from being influenced by a previous state where the detection-permitting conditions were not satisfied, it is preferable to wait $T_2$ seconds after the detection-permitting conditions were satisfied before the variation ΔFT in the FIC rate, the absolute value V of the A/F ratio sensor output, and the variation ΔV in the A/F ratio sensor output are added to the cumulative value ΣΔFT (i.e., $S_1$), the cumulative value ΣV (i.e., $S_2$), and the cumulative value ΣΔV (i.e., $S_3$), respectively. Thus, the accuracy of the cumulative data of the variation ΔFT in the FIC rate, the cumulative data of the A/F ratio sensor output values V, and the cumulative data of the variation ΔV in the A/F ratio sensor output is ensured. Preferably, $T_1$ and $T_2$ satisfy the relationship $T_1 \leqq T_2$. If it is determined at step S703 that $T_2$ seconds have not passed after the affirmation of the detection-permitting conditions, step S712 is performed to store the current A/F ratio sensor output and step S713 is performed to store the current FIC rate FT, and thereafter the control exits the routine. If it is determined at step S703 that $T_2$ seconds have passed after the affirmation of the detection-permitting conditions, then the control proceeds to the next step S704.

At step S704, the absolute value V of the A/F ratio sensor output is calculated and added to the cumulative value obtained up to the previous call of the routine (i.e., $\Sigma V_{m-1}$), thereby updating the cumulative value ΣV. In the case where the A/F ratio sensor output corresponding to the stoichiometric A/F ratio is not zero, e.g., if the A/F ratio sensor output corresponding to the stoichiometric A/F ratio is designed to have a certain offset value, the offset value is eliminated before the cumulation calculation. If the control target of the A/F ratio is not the stoichiometric A/F ratio, the cumulation calculation can be directed to the cumulation of the absolute values of offsets from the target A/F ratio. When step S704 is performed for the first time after the conditions of steps S701 to S703 are satisfied, an initial value (=0) is substituted for the cumulative value ($\Sigma V_{m-1}$) obtained up to the previous call of the routine (the initial value is used when the detection-permitting conditions are not satisfied at step S701).

At step S705, the absolute value of a difference between the A/F ratio sensor output ($V_m$) and the A/F ratio sensor output ($V_{m-1}$) previously stored at step S711 in a previous call of the routine (i.e., $\Delta V_m = |V_m - V_{m-1}|$) is calculated, and the difference (or "variation") $\Delta V_m$ is added to the cumulative value obtained up to the previous call of the routine (i.e., $\Sigma\Delta V_{m-1}$), thereby updating the cumulative value ΣΔV). When step S705 is performed for the first time after the conditions of steps S701 to S703 are satisfied, an initial value (=0) is substituted for the cumulative value ($\Sigma\Delta V_{m-1}$) obtained up to the previous call of the routine (the initial value is used when the detection-permitting conditions are not satisfied at step S701).

At step S706, the absolute value of a difference between the current FIC rate ($FT_m$) and the FIC rate ($FT_{m-1}$) previously stored at step S713 in a previous call of the routine (i.e., $\Delta FT_m = |FT_m - FT_{m-1}|$) is calculated, and the difference (or "variation") $\Delta FT_m$ is added to the cumulative value obtained up to the previous call of the routine (i.e., $\Sigma\Delta FT_{m-1}$), thereby updating the cumulative value ΣΔFT) When step S706 is performed for the first time after the conditions of steps S701 to S703 are satisfied, an initial value (=0) is substituted for the cumulative value ($\Sigma\Delta FT_{m-1}$) obtained up to the previous call of the routine (the initial value is used when the detection-permitting conditions are not satisfied at step S701).

Step S707 counts the number of times the cumulation process has been performed at steps 5704, S705, and S706. If the cumulation process has been performed m times, it is known that the cumulation of the variation ΔFT in the FIC rate, the absolute value V of the A/F ratio sensor output, and the variation ΔV in the A/F ratio sensor output has been performed for $T_s = m \times T_1$ (defined as "hitherto-performed cumulation time") in total. Assuming that the cumulation process is to be performed a total of M times (as counted at step S707 described later), the process of cumulating the variation ΔFT in the FIC rate, the absolute value V of the A/F ratio sensor output, and the variation ΔV in the A/F ratio sensor output must be performed for a predetermined time duration of $T_\Sigma = M \times T_1$ (defined as the "cumulation time"). Alternatively, it is possible to control the predetermined time duration (cumulation time) by measuring the duration $T_{cont}$ of cumulation continued after the condition of step S703 is satisfied (i.e., $T_2$ seconds or more-have passed).

The value of M representing the number of times the cumulation process is to be performed (or the cumulation time $T_\Sigma$), or the duration $T_\Sigma'$ of cumulation to be continued after the condition of step S703 is satisfied, is prescribed so that the cumulation process will be performed for a period of time sufficiently longer than the variation cycle of the FIC rate and the variation cycle of A/F ratio sensor output due to the feedback correction.

At step S708, it is determined whether or not the value of m (i.e., the number of times the cumulation process has been hitherto performed), as counted at step S707, is equal to or greater than the above-mentioned predetermined value M (i.e., the total number of times the cumulation process is to be performed). Alternatively, in the case where the cumulation time $T_\Sigma$ is controlled by measuring the duration $T_{cont}$ of cumulation after the condition of step S703 is satisfied, it is determined at step S708 whether or not the duration $T_{cont}$ of cumulation after the condition of step S703 is satisfied is equal to or greater than the duration $T_\Sigma'$ of cumulation to be continued after the condition of step S703 is satisfied.

It should be noted that the cumulation time $T_\Sigma$, during which the variation $\Delta FT_m$ in the FIC rate, the absolute value V of the A/F ratio sensor output, and the variation ΔV in the A/F ratio sensor output are cumulated, need not be one continuous stretch of time. For example, if any of the detection-permitting conditions at step S701 is not satisfied before the hitherto-performed cumulation time $T_s$ reaches the predetermined value $T_\Sigma$, the cumulative value $S_1$ (i.e., ΣΔFT) of the variation ΔFT in the FIC rate, the cumulative value $S_2$ (i.e., ΣV) of the absolute value V of the A/F ratio sensor output, the cumulative value $S_3$ (i.e., ΣΔV) of the variation ΔV in the A/F ratio sensor output, the cumulation time $T_s$ (defined in terms of m, i.e., a number of times the cumulation process has been performed, or in terms of $T_{cont}$, i.e., a duration of cumulation after the condition of step S703 is satisfied) and the like can be stored without being cleared, so that these values can be utilized when the process is resumed after the conditions of steps S701 to S703 are again satisfied, and the cumulation process of the variation ΔFT in the FIC rate, the absolute value V of the A/F ratio sensor output, and the variation ΔV in the A/F ratio sensor output as well as the counting of the number m or the duration $T_{cont}$ of cumulation can be continued after the condition of step S703 is satisfied. Such resumption and continuation of the process will be described later in more detail. If the condition of step S708 is satisfied (i.e., if the cumulation process has been performed for the predetermined cumulation time $T_\Sigma$), then the control proceeds to step S709. If the condition of step S708 is not satisfied, only step S712 (i.e., storing the current A/F ratio sensor output) and step S713 (i.e., storing the current FIC rate) are performed and thereafter the control exits the routine.

At step S709, a ratio P of the cumulative value ΣΔFT of the variation in the FIC rate and the cumulative value ΣΔV of the variation in the A/F ratio sensor output (i.e, P=ΣΔFT/ΣΔV) is calculated. Moreover, a ratio Q of the cumulative value ΔV of the absolute values of the A/F ratio sensor output and the cumulative value ΣΔV of the variation in the A/F ratio sensor output (i.e., Q=ΣV/ΣΔV) is calculated.

At step S710, a product R of PQ derived at step S708 is calculated [i.e., R=PQ=(ΣΔFT/ΣΔV)×(ΣV/ΣΔV)], and it is determined whether or not the product R exceeds a predetermined threshold value R(th). If the product R does not exceed the threshold value R(th), the A/F ratio sensor is determined as having normal characteristics (step S711*b*). If the product R exceeds the threshold value R(th), the A/F ratio sensor is determined as malfunctioning or having deteriorated characteristics (step S711*a*). When the A/F ratio sensor is determined as malfunctioning, a malfunction alert indicator within an instrument panel may be lit, for example.

The comparison between the product $R=(\Sigma\Delta FT\times\Sigma V)/(\Sigma\Delta V)^2$ against the threshold value R(th) can also be made as follows, for example: A reference product $R_0$, defined as a product $(\Sigma\Delta FT\times\Sigma V)/(\Sigma\Delta V)^2$ of an A/F ratio sensor known to have normal response characteristics, is previously calculated. Then, it can be determined whether or not the ratio of the above-mentioned product R to the reference product $R_0$ exceeds the threshold value R(th).

EXAMPLE 7

Figure 21:
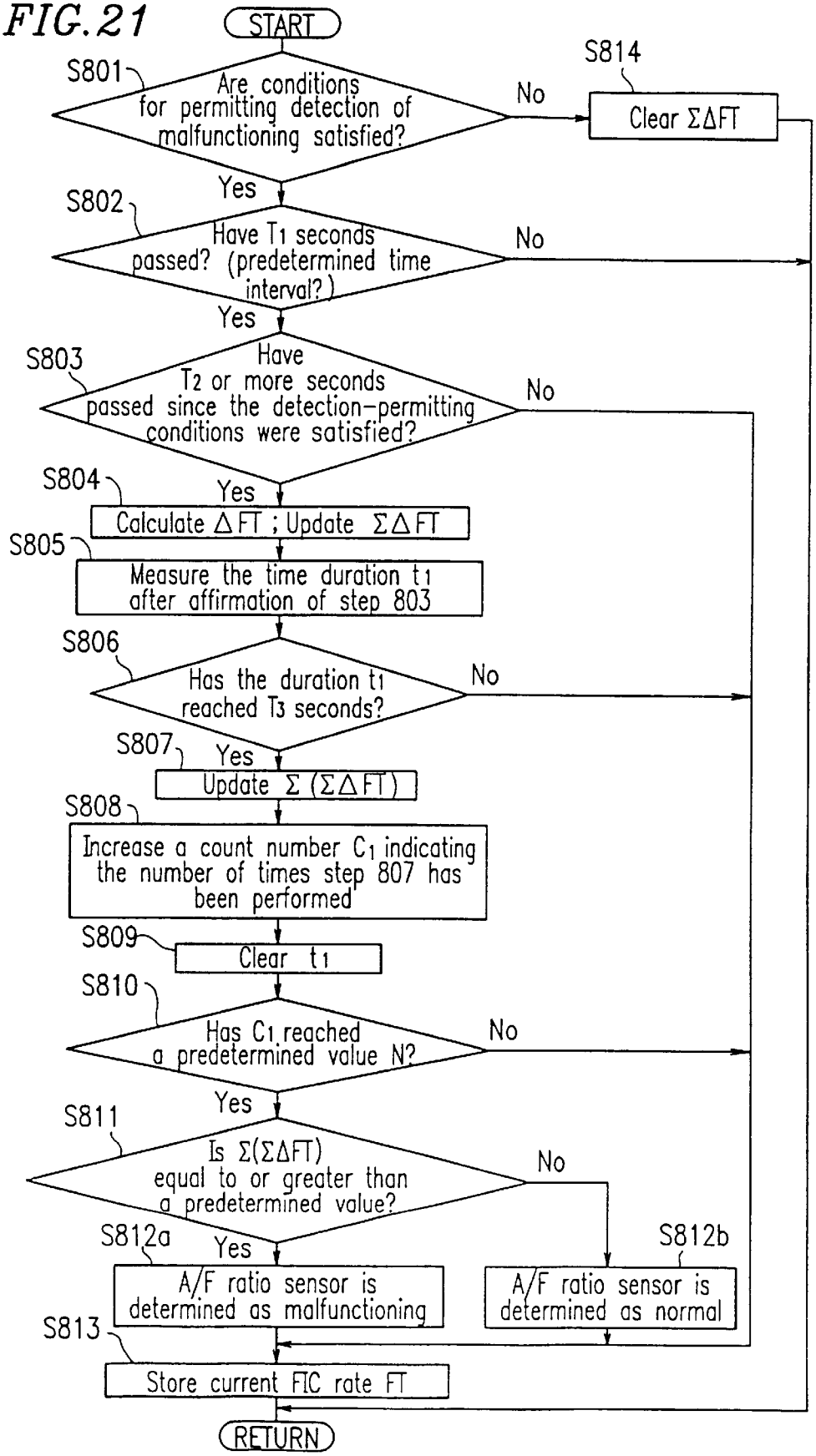
FIG. 21 is a flow diagram illustrating the A/F ratio sensor OUTPUT DETERIORATION (MALFUNCTIONING) DETERMINATION routine for determining the deterioration of an A/F ratio sensor output according to Example 7 of the present invention.

As Example 7 of the present invention, a procedure for determining the deterioration in the response characteristics of an A/F ratio sensor based on the cumulative value $S_1$ (i.e., ΣΔFT) of the variation ΔFT in the FIC rate as in Example 1 will be described with reference to a flow diagram of FIG. 21 showing the A/F ratio sensor OUTPUT DETERIORATION (MALFUNCTIONING) DETERMINATION routine according to Example 7. The resent example illustrates an example where the cumulation time $T_\Sigma$, during which the variation ΔFT in the FIC rate is cumulated, is not one continuous stretch of time. The illustrated principle of resumption and continuation of the process can be similarly applied to the routines of the above-described Examples.

As shown in FIG. 21, at step S801, it is determined whether or not the conditions are satisfied for permitting the execution of the process for detecting the malfunctioning of the A/F ratio sensor (hereinafter such conditions are referred to as "detection-permitting conditions"). The detection-permitting conditions may include, for example, that the travel speed of the automobile is within a predetermined range; that the rotation rate of the engine is within a predetermined range; that a feedback control is ongoing; and that other components and the system are free from malfunctions which may cause misdetections. Such detection-permitting conditions are checked by detecting the input signals from various sensors. If the detection-permitting conditions are satisfied, the control proceeds to the next step S802. If the detection-permitting conditions are not satisfied, the cumulative value $S_1$ (=ΣΔFT) up to the previous call of the routine is cleared at step S814 and thereafter the control exits the routine.

The detection-permitting conditions must be satisfied in order to ensure that only accurate FIC rate values are used for the calculation of the variation ΔFT in the FIC rate at each time interval $T_1$.

The variation ΔFT in the FIC rate is calculated at every predetermined time interval $T_1$. The time interval $T_1$ is required to be sufficiently short so that the detection of the variation in the FIC rate can be accurate. At step S802, it is determined whether or not the routine cycle (i.e., as determined by a predetermined clock) is at a point where it coincides with a cycle defined by the time interval $T_1$ for calculating the variation ΔFT in the FIC rate. If it is determined that the routine cycle does not coincide with the cycle defined by the time interval $T_1$, the control exits the routine without performing any processes. If it is determined that the routine cycle coincides with the cycle defined by the time interval $T_1$, the control proceeds to the next step S803.

The cycle of the malfunctioning detection routine must be prescribed as equal to or smaller than the time interval $T_1$ for calculating the variation ΔFT in the FIC rate. Step S802 can be omitted in the case where the cycle of the malfunctioning detection routine is prescribed as equal to the time interval $T_1$ for calculating the variation ΔFT in the FIC rate.

At step S803, it is determined whether or not $T_2$ seconds have passed since the detection-permitting conditions were confirmed to be satisfied at step S801. The reasons for performing the determination of step S803 are as follows: As described above, the detection-permitting conditions of step S801 must be satisfied in order to ensure that only accurate FIC rate values are used for the calculation of the variation ΔFT in the FIC rate at every time interval $T_1$. In order to prevent the cumulation process from being influenced by a previous state where the detection-permitting conditions were not satisfied, it is preferable to wait $T_2$ seconds after the detection-permitting conditions were satisfied before the variation ΔFT in the FIC rate is added to the cumulative value ΣΔFT (i.e., $S_1$). Thus, the accuracy of the cumulative data of the variation ΔFT in the FIC rate is ensured. Preferably, $T_1$ and $T_2$ satisfy the relationship $T_1 \leqq T_2$. If it is determined at step S803 that $T_2$ seconds have not passed after the affirmation of the detection-permitting conditions, step S813 is performed to store the current FIC rate FT, and thereafter the control exits the routine. If it is determined at step S803 that $T_2$ seconds have passed after the affirmation of the detection-permitting conditions, then the control proceeds to the next step S804.

At step S804, the absolute value of a difference between the current FIC rate ($FT_m$) and the FIC rate ($FT_{m-1}$) previously stored at step S813 in a previous call of the routine (i.e., $\Delta FT_m=|FT_m-FT_{m-1}|$) is calculated, and the difference (or "variation") $\Delta FT_m$ is added to the cumulative value obtained up to the previous call of the routine (i.e., $\Sigma\Delta FT_{m-1}$) thereby updating the cumulative value ΣΔFT). When step S804 is performed for the first time after the conditions of steps S801 to S803 are satisfied, an initial value (=0) is substituted for the cumulative value ($\Sigma\Delta FT_{m-1}$) obtained up to the previous call of the routine (the initial value is used when the detection-permitting conditions are not satisfied at step S801).

Step S805 measures the time duration $t_1$ after the affirmation of the condition of step S803 (i.e., that $T_2$ seconds or more have passed since the detection-permitting conditions were satisfied at step S801).

Step S806 determines whether or not the duration $t_1$ has reached a predetermined time $T_3$. If the duration $t_1$ has not reached the predetermined time $T_3$, only step S813 (i.e., storing the current FIC rate) is performed and the control returns to step S801 so that the routine is repeated. In other words, the calculation of ΔFT is performed to keep updating the cumulative value ΣΔFT (steps S801 to S805) until the duration $t_1$ reaches the predetermined time $T_3$. If it is determined at step S806 that the duration $t_1$ has reached the predetermined time $T_3$, the control proceeds to step S807.

At step S807, the hitherto-obtained cumulative value ΣΔFT, i.e., ΣΔFT obtained for the last $T_3$ seconds, is added to the ΣΔFT from the previous sets of $T_3$ seconds, thereby updating the value of Σ(ΣΔFT). When the calculation of the cumulative value ΣΔFT for $T_3$ seconds at step S807 is performed for the first time, an initial value (=0) is substituted for the "cumulative value ΣΔFT from the previous $T_3$ seconds" (the initial value is used when the detection-permitting conditions are not satisfied at step S801).

At step S808, the number of times step S807 has been performed is counted by using e.g., a counter, so as to increase a count number $C_1$. At step S809, the time $t_1$ measured at step S805 is cleared.

At step S810, it is determined whether or not the count number $C_1$ has exceeded a predetermined value N. If the count number $C_1$ has not exceeded a predetermined value N, only step S813 (i.e., storing the current FIC rate) is performed and thereafter the control returns to step S801 to repeat the routine In other words, the cumulation of ΣΔFT for $T_3$ seconds is performed to give Σ(ΣΔFT) (steps S801 to S809) until the count number $C_1$ reaches the predetermined number N. If it is determined at step S810 that the count number $C_1$ has reached the predetermined number N, the control proceeds to step S811.

At step S811, the hitherto-obtained cumulative value Σ(ΣΔFT), i.e., the cumulative value of ΔFT for $T_3 \times C_1$ seconds, is compared with a predetermined threshold value $\Sigma(\Sigma\Delta FT)_{th}$. If the cumulative value Σ(ΣΔFT) has not exceeded the threshold value $\Sigma(\Sigma\Delta FT)_{th}$, the A/F ratio sensor is determined as having normal characteristics (step S812*b*). If the cumulative value Σ(ΣΔFT) has exceeded the threshold value $\Sigma(\Sigma\Delta FT)_{th}$, the A/F ratio sensor is determined as malfunctioning or having deteriorated characteristics (step S812*a*). When the A/F ratio sensor is determined as malfunctioning, a malfunction alert indicator within an instrument panel may be lit, for example.

In the present example, if any of the detection-permitting conditions at step S801 is not satisfied before the count number $C_1$ of the counter reaches the predetermined value N, the cumulative value $S_1$ (i.e., ΣΔFT) for $T_3$ seconds, which was still under way at that point in time (when $t_1 < T_3$), is cleared at step S814; however, the cumulation of the past cumulative values Σ(ΣΔFT) is still stored without having been cleared. Therefore, the "cumulation for $T_3$ seconds" (for obtaining ΣΔFT) can be resumed after the conditions of step S801 are again satisfied, to be continued until the count number $C_1$ reaches the predetermined number N. Thus, the cumulation of the variation in the FIC rate can be performed for $C_1 \times T_3$ seconds=$T_\Sigma$.

In the present example, by prescribing $T_3$ at a short value relative to the predetermined cumulation time $T_\Sigma$, it becomes possible to efficiently perform the cumulation of the variation in the FIC rate even if the detection-permitting conditions of step S801 are repetitively satisfied or dissatisfied, thereby enabling an early detection of the malfunctioning of the A/F ratio sensor.

An early detection of the malfunctioning of an A/F ratio sensor can also be achieved by methods other than the method of Example 7, e.g., by performing discontinuous or intermittent cumulation processes of the variation in the FIC rate.

The discontinuous cumulation process of the variation in the FIC rate according to the present example, which is performed until reaching the predetermined cumulation time $T_\Sigma$, can be applied to the other Examples of the present invention For example, the discontinuous cumulation process can be applied in Example 2 by replacing steps S301 to S306 (FIG. 16) with steps S801 to S810 of Example 7.

Thus, the A/F ratio sensor deterioration detection device has been described with respect to illustrative but non-limiting Examples. For example, it is possible to determine the deterioration of the A/F ratio sensor by combining any of two or more methods described in Examples 1 to 6, rather than employing each method alone. The specific configuration of the A/F ratio sensor deterioration detection device can be adopted by, e.g., combining one or more the determination methods in the respective Examples, depending on the type and the degree of deterioration of the subject A/F ratio sensor.

Thus, in an A/F ratio control apparatus employing an A/F ratio sensor capable of continuously detecting an A/F ratio within a broad range of values including the stoichiometric A/F ratio, the invention described herein advantageously provides a device for achieving an early detection of the deterioration of the A/F ratio sensor without relying on the sensor characteristics in control ranges outside the stoichiometric value.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A device for determining deterioration of an air-fuel ratio sensor, the device comprising:

an air-fuel ratio sensor provided in an exhaust passage of an internal combustion engine, the air-fuel ratio sensor being capable of continuously detecting a broad range of air-fuel ratios including a stoichiometric air-fuel ratio;

air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine;

variation cumulative value calculation means for cumulating, while the air-fuel ratio feedback control is being performed by the air-fuel ratio feedback control means, a variation ΔFT in a fuel injection correction amount, thereby calculating a cumulative variation value ΣΔFT for a predetermined period; and deterioration determination means for determining that the air-fuel ratio sensor is deteriorated when the cumulative variation value ΣΔFT calculated by the variation cumulative value calculation means exceeds a predetermined value.

2. A device for determining deterioration of an air-fuel ratio sensor, the device comprising:

an air-fuel ratio sensor provided in an exhaust passage of an internal combustion engine, the air-fuel ratio sensor being capable of continuously detecting a broad range of air-fuel ratios including a stoichiometric air-fuel ratio;

air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially, equals the target air-fuel ratio, the gaseous mixture being supplied to the engine;

output cumulative value calculation means for cumulating, while the air-fuel ratio feedback control is being performed by the air-fuel ratio feedback control means, at least one of an absolute value of output of the air-fuel ratio sensor and a difference between the output of the air-fuel ratio sensor and the target output, thereby calculating a cumulative output value $\Sigma V$ for a predetermined period; and deterioration determination means for determining that the air-fuel ratio sensor is deteriorated when the cumulative output value $\Sigma V$ calculated by the output cumulative value calculation means exceeds a predetermined value.

3. A device for determining deterioration of an air-fuel ratio sensor, the device comprising:

an air-fuel ratio sensor provided in an exhaust passage of an internal combustion engine, the air-fuel ratio sensor being capable of continuously detecting a broad range of air-fuel ratios including a stoichiometric air-fuel ratio;

air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine;

variation cumulative value calculation means for cumulating, while the air-fuel ratio feedback control is being performed by the air-fuel ratio feedback control means, a variation $\Delta V$ in output of the air-fuel ratio sensor, thereby calculating a cumulative variation value $\Sigma\Delta V$ for a predetermined period; and deterioration determination means for determining that the air-fuel ratio sensor is deteriorated when the cumulative variation value $\Sigma\Delta V$ calculated by the variation cumulative value calculation means exceeds a predetermined value.

4. A device for determining deterioration of an air-fuel ratio sensor, the device comprising:

an air-fuel ratio sensor provided in an exhaust passage of an internal combustion engine, the air-fuel ratio sensor being capable of continuously detecting a broad range of air-fuel ratios including a stoichiometric air-fuel ratio;

air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine;

variation cumulative value calculation means for cumulating, while the air-fuel ratio feedback control is being performed by the air-fuel ratio feedback control means, a variation $\Delta FT$ in a fuel injection correction amount and a variation $\Delta V$ in output of the air-fuel ratio sensor, thereby respectively calculating a cumulative variation value $\Sigma\Delta FT$ and a cumulative variation value $\Sigma\Delta V$ for a predetermined period; and deterioration determination means for determining if the air-fuel ratio sensor is deteriorated based on a ratio between the cumulative variation value $\Sigma\Delta FT$ and the cumulative variation value $\Sigma\Delta V$ calculated by the variation cumulative value calculation means.

5. A device for determining deterioration of an air-fuel ratio sensor, the device comprising:

an air-fuel ratio sensor provided in an exhaust passage of an internal combustion engine, the air-fuel ratio sensor being capable of continuously detecting a broad range of air-fuel ratios including a stoichiometric air-fuel ratio;

air-fuel ratio feedback control means for feedback controlling a fuel injection amount based on a difference between an output of the air-fuel ratio sensor and a target output corresponding to a target air-fuel ratio so that an air-fuel ratio of a gaseous mixture substantially equals the target air-fuel ratio, the gaseous mixture being supplied to the engine;

variation cumulative value calculation means for cumulating, while the air-fuel ratio feedback control is being performed by the air-fuel ratio feedback control means, output V of the air-fuel ratio sensor and a variation $\Delta V$ in the output of the air-fuel ratio sensor, thereby respectively calculating a cumulative output value $\Sigma V$ and a cumulative variation value $\Sigma\Delta V$ for a predetermined period; and deterioration determination means for determining if the air-fuel ratio sensor is deteriorated based on a ratio between the cumulative output value $\Sigma V$ and the cumulative variation value $\Sigma\Delta V$ calculated by the variation cumulative value calculation means.

6. A device for determining the deterioration of an air-fuel ratio sensor according to claim 5 further comprising variation cumulative value calculation means for cumulating, while the air-fuel ratio feedback control is being performed by the air-fuel ratio feedback control means, a variation $\Delta FT$ in a fuel injection correction amount and a variation $\Delta V$ in output of the air-fuel ratio sensor, thereby respectively calculating a cumulative variation value $\Sigma\Delta FT$ and a cumulative variation value $\Sigma\Delta V$ for a predetermined period, wherein the deterioration determination means determines if the air-fuel ratio sensor is deteriorated based on a ratio between the cumulative output value $\Delta V$ and the cumulative variation value $\Sigma\Delta V$ and a ratio between the cumulative variation value $\Sigma\Delta FT$ and the cumulative variation value $\Sigma\Delta V$.

7. A device for determining the deterioration of an air-fuel ratio sensor according to claim 6, wherein the deterioration determination means determines if the air-fuel ratio sensor is deteriorated based on a product of a ratio between the cumulative output value $\Sigma V$ and the cumulative variation value $\Sigma\Delta V$ and a ratio between the cumulative variation value $\Sigma\Delta FT$ and the cumulative variation value $\Sigma\Delta V$.

* * * * *